US012516524B2

(12) United States Patent
Yaakov et al.

(10) Patent No.: US 12,516,524 B2
(45) Date of Patent: Jan. 6, 2026

(54) ARCH FOR METAL CANOPY WITHOUT WELDING

(71) Applicants: Eliyahu Yaakov, Moshav Matzliah (IL); Avraham Yaakov, Moshav Matzliah (IL)

(72) Inventors: Eliyahu Yaakov, Moshav Matzliah (IL); Avraham Yaakov, Moshav Matzliah (IL)

( * ) Notice: Subject to any disclaimer, the term of this patent is extended or adjusted under 35 U.S.C. 154(b) by 0 days.

(21) Appl. No.: 18/406,157

(22) Filed: Jan. 7, 2024

(65) Prior Publication Data

US 2025/0223805 A1 Jul. 10, 2025

(51) Int. Cl.
*E04C 3/11* (2006.01)
*E04C 3/04* (2006.01)

(52) U.S. Cl.
CPC ..... *E04C 3/11* (2013.01); *E04C 2003/0491* (2013.01)

(58) Field of Classification Search
CPC ..... E04C 3/11; E04C 2003/0491; E04C 3/04; E04C 3/08; E04C 3/02; E04C 3/17; E04C 2003/0473; E04B 1/24; E04B 1/1903; E04B 1/18; E04B 1/19
USPC ..... 52/633, 637, 638, 648.1, 639
See application file for complete search history.

(56) References Cited

U.S. PATENT DOCUMENTS

| | | | | | |
|---|---|---|---|---|---|
| 2,201,504 | A * | 5/1940 | Ruppel | E04C 3/11 | 52/643 |
| 2,262,120 | A * | 11/1941 | Smits | E04C 3/11 | 52/745.19 |
| 5,542,227 | A * | 8/1996 | Frayne | E04C 3/11 | 52/639 |
| 6,318,043 | B1 * | 11/2001 | Johnson | E04H 1/1205 | 52/643 |
| 7,143,550 | B1 * | 12/2006 | Lopez | E04B 1/3205 | 52/81.3 |
| 11,560,717 | B2 * | 1/2023 | Yaakov | E04C 3/40 | |
| 2002/0073643 | A1 * | 6/2002 | Snow | E04C 3/17 | 52/693 |
| 2004/0237451 | A1 * | 12/2004 | Elderson | E04B 2/7457 | 52/637 |
| 2005/0229528 | A1 * | 10/2005 | Kardosz | E04C 3/11 | 52/639 |
| 2006/0123733 | A1 * | 6/2006 | Moody | E04C 3/292 | 52/634 |
| 2006/0150560 | A1 * | 7/2006 | Hughes | E04C 3/11 | 52/633 |
| 2008/0178555 | A1 * | 7/2008 | Green | E04C 3/38 | 52/690 |

(Continued)

*Primary Examiner* — Brian E Glessner
*Assistant Examiner* — Adam G Barlow
(74) *Attorney, Agent, or Firm* — Rivka Friedman

(57) ABSTRACT

An arch for a metal canopy, including: a right-hand rafter; a left-hand rafter; and an apex brace, wherein each of the right-hand and left-hand rafters includes: an upper rafter beam and a lower rafter beam, the upper and lower rafter beams having an I-beam shape, a plurality of pylons, each of the pylons having upper and lower I-shaped opening adapted to receive therethrough the upper and rafter beams respectively, and at least a portion of the pylons including an opening for receiving the apex brace therethrough, and a plurality of slanted profiles disposed between the every two pylons of the plurality of pylons.

4 Claims, 33 Drawing Sheets

(56) References Cited

U.S. PATENT DOCUMENTS

| | | | | |
|---|---|---|---|---|
| 2010/0326003 | A1* | 12/2010 | Davies | E04C 3/02 52/655.1 |
| 2012/0192520 | A1* | 8/2012 | Hsieh | E04B 7/024 52/836 |
| 2014/0144097 | A1* | 5/2014 | Green | E04B 1/18 52/643 |
| 2016/0060867 | A1* | 3/2016 | Green | E04C 3/40 52/639 |
| 2017/0096823 | A1* | 4/2017 | Apostolopoulos | E04G 5/06 |
| 2017/0101748 | A1* | 4/2017 | Thrall | E01D 6/00 |
| 2017/0275869 | A1* | 9/2017 | Reed, Jr. | E04D 13/1668 |
| 2022/0389709 | A1* | 12/2022 | LeBlang | E04B 2/58 |

* cited by examiner

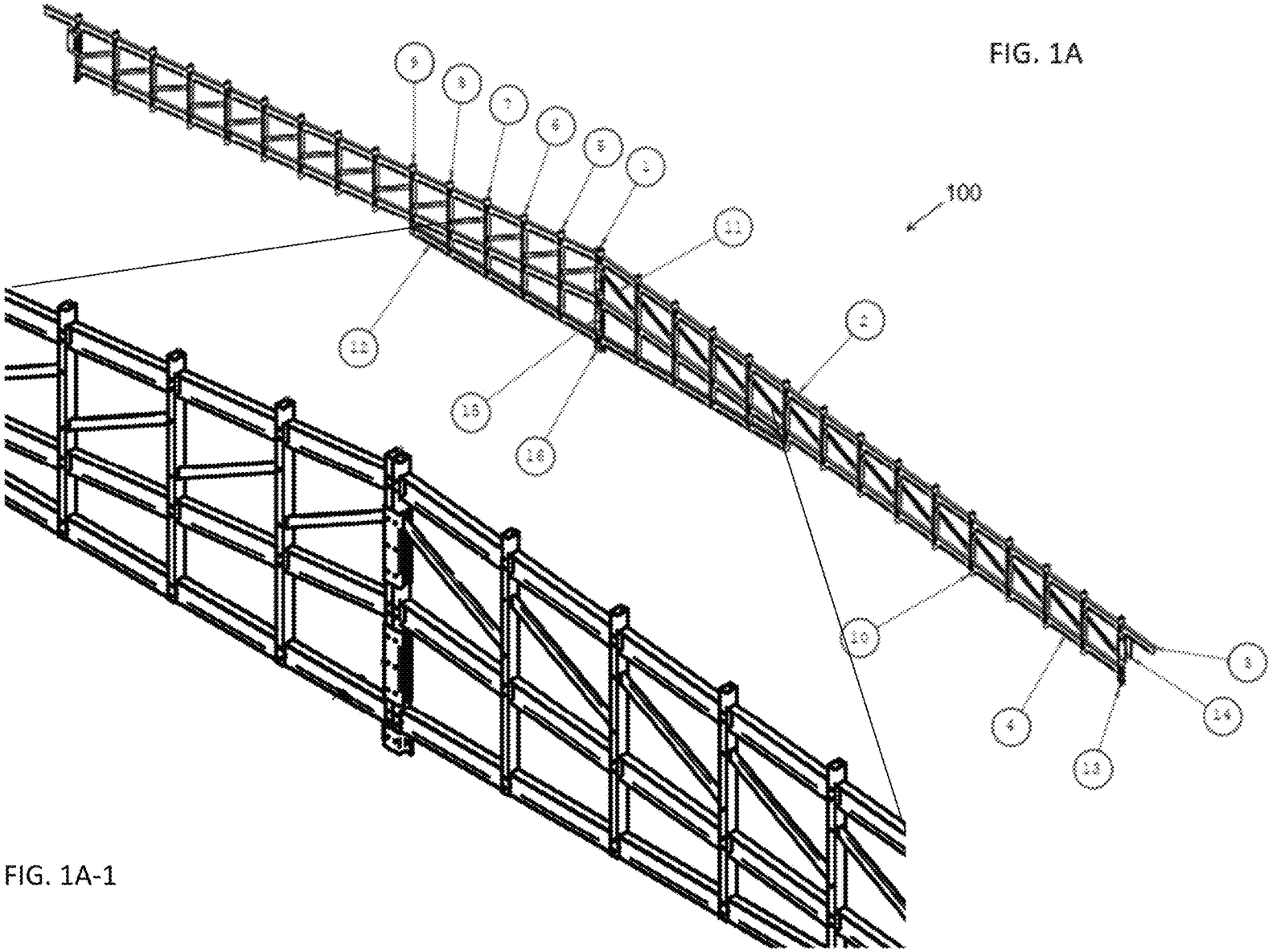
100
4
4
4

ARCH FOR METAL CANOPY WITHOUT WELDING

FIELD OF THE INVENTION

The present invention relates to a galvanized steel structures and, more particularly, to structures that can be assembled laser cut pieces fastened together with fasteners There is no need for excessive manpower, or any on-location cutting or welding.

BACKGROUND OF THE INVENTION

Almost all steel structures suffer from inadequacies during assembly. Similar pieces are bought in bulk and cut to size, bent to shape and welded in place as necessary. The on-location activities extend the assembly period, necessitate additional manpower and man hours of work and are wasteful of the building materials. Furthermore, galvanized steel is protected by the elements as a result of the galvanization process. However, the galvanized pieces are generally subjected to on-location changes (cutting, bending, welding, etc.), most of which ruin the weather-proof seal of the galvanization. As a result, the assembled pieces look dirty, scorched and defaced as well as suffering from early corrosion at the joins, seams and welding points.

U.S. patent Ser. No. 11/560,717 to Yaakov et al. discloses a metal canopy 700 which is incorporated by reference as if fully set forth herein.

FIG. 31 is an isometric view of a prior art metal canopy structure 700 which includes a plurality of arches 710 arranged in parallel formation, equally spaced apart. Each of the arches has a planar construction and is disposed on a separate plane running along a first axis. For the sake of clarity, the first axis is referred to herein as the X-axis.

A plurality of cross beams 704, are placed on top of the arches. At least a portion of beams 704 are arranged in parallel formation. A single beam or multiple beams span/s the length of the entire canopy. Each of the cross beams is disposed on a second axis perpendicular to the first axis. For the sake of clarity, this axis is referred to herein as the Z-axis. Each of the beams is mechanically coupled to at least a portion of the plurality of arches (e.g., one beam may be coupled to half the arches while a second beam is also coupled to half the arches and both beams are coupled to the middle arch; alternatively, each beam is coupled to all the arches).

There are a number of support poles 702 on which the arches rest. Each of the arches is mechanically coupled to a pair of support poles 702. As such, the support poles are positioned at regular intervals along the second axis. To be sure, each support pole itself is installed in the ground longitudinally, along a third, vertical axis (hereafter Y-axis).

There is also a plurality of coupling poles 706, that are disposed between the support poles which provide increased support and rigidity to the structure. The coupling poles 706 are disposed along the second axis (Z-axis). The coupling poles are mechanically coupled to the plurality of support poles, such that at least a portion of the coupling poles are arranged in a parallel formation, spaced apart at equal intervals (on a plane disposed on the Y-axis).

SUMMARY OF THE INVENTION

There are provided herein various structures that are assembled from laser cut galvanized steel pieces and fasteners. No changes need to be to the pieces, leaving the weather-proof finish intact and obviating the need for on-location manipulation of the pieces (i.e. no welding, cutting, bending etc.). The pieces arrive from the factory precut to exact dimensions and galvanized. There is no excessive transportation of materials. Assembly is fast and can be accomplished with a small team of two to four workers.

According to the present invention there is provided an arch for a metal canopy, including: a right-hand rafter; a left-hand rafter; and an apex brace, wherein each of the right-hand and left-hand rafters includes: an upper rafter beam and a lower rafter beam, the upper and lower rafter beams having an I-beam shape, a plurality of pylons, each of the pylons having upper and lower I-shaped opening adapted to receive therethrough the upper and rafter beams respectively, and at least a portion of the pylons including an opening for receiving the apex brace therethrough, and a plurality of slanted profiles disposed between the every two pylons of the plurality of pylons.

According to further features the apex brace is an I-beam shaped metal profile.

According to still further features a central pylon of the left-hand rafter is coupled to a central pylon of the right-hand rafter by metal holder plates that sandwich the central pylons between them.

According to still further features an upper end of each slanted profile slots into an opening in a respective pylon of the plurality of pylons.

BRIEF DESCRIPTION OF THE DRAWINGS

Various embodiments are herein described, by way of example only, with reference to the accompanying drawings, wherein:

FIGS. 1A-C are various views of one arch 100 of a metal canopy which is constructed from a plurality of such arches;

DESCRIPTION OF THE PREFERRED EMBODIMENTS

The principles and operation of an arch for a metal canopy according to the present invention may be better understood with reference to the drawings and the accompanying description.

Figures 1, 1B, 1C:
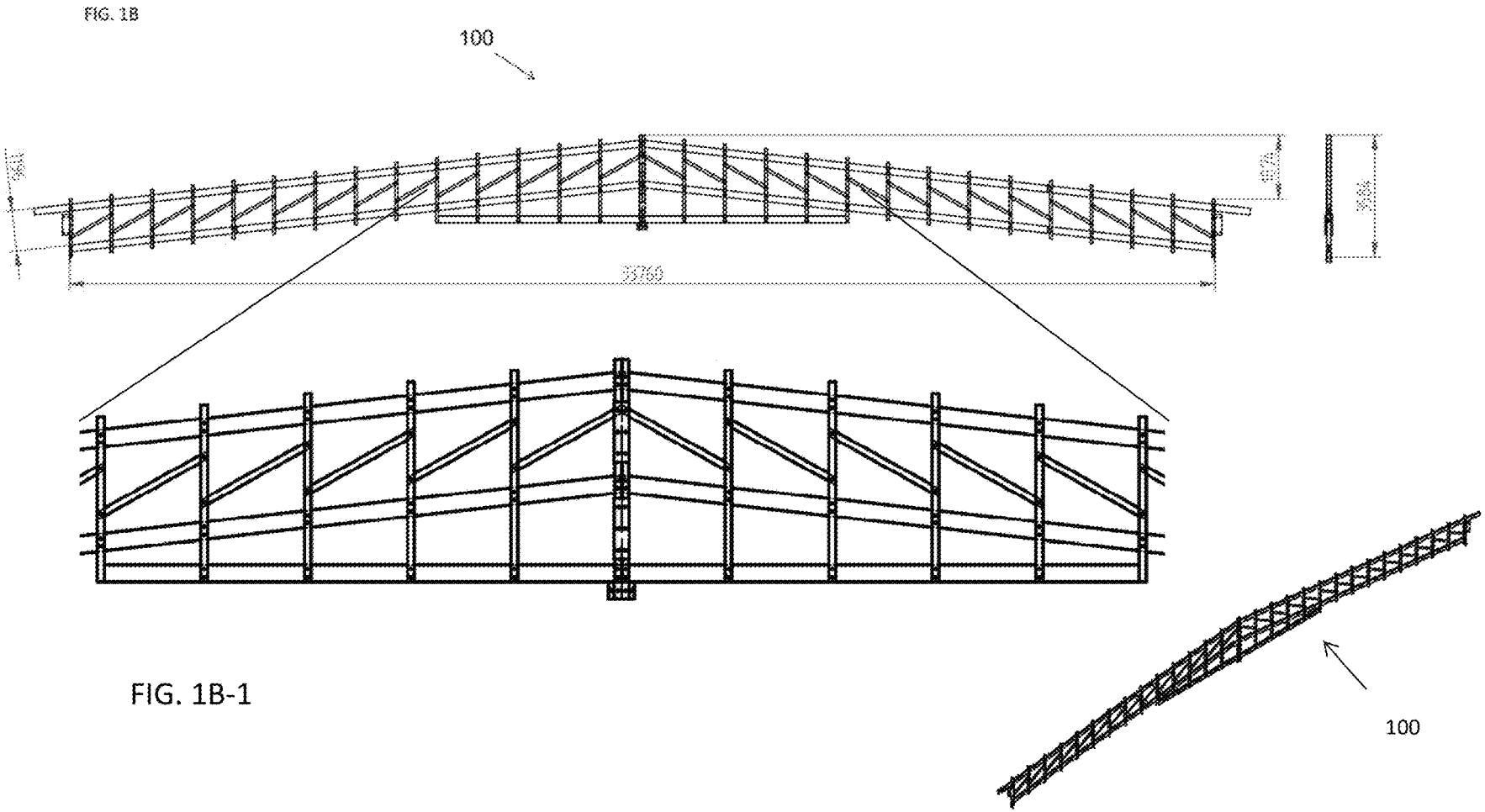
Figure 2A:
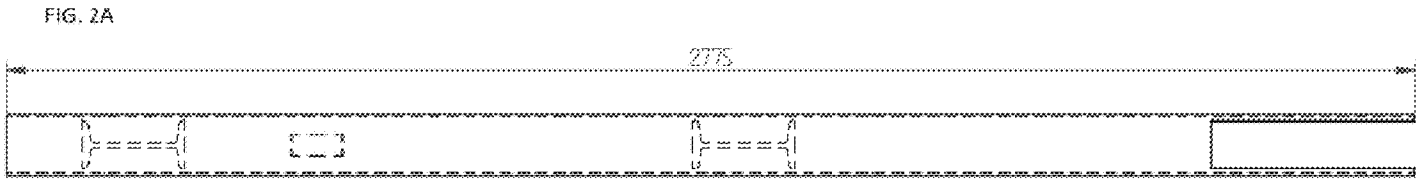
FIGS. 2A-E are various views of a central pylon (1) (120-80-2575) of the arch.
Figure 2B:
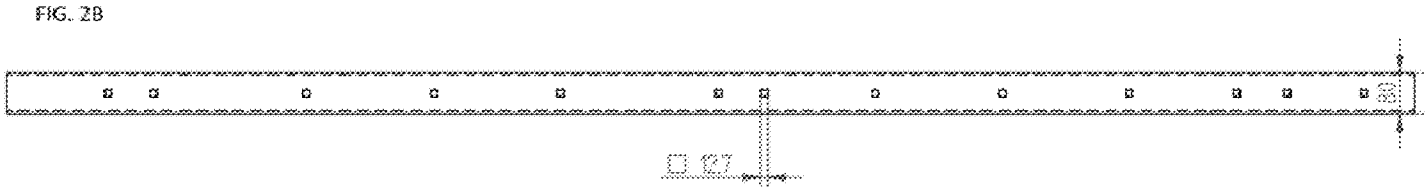
Figure 2D:
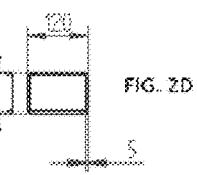
Figure 2C:
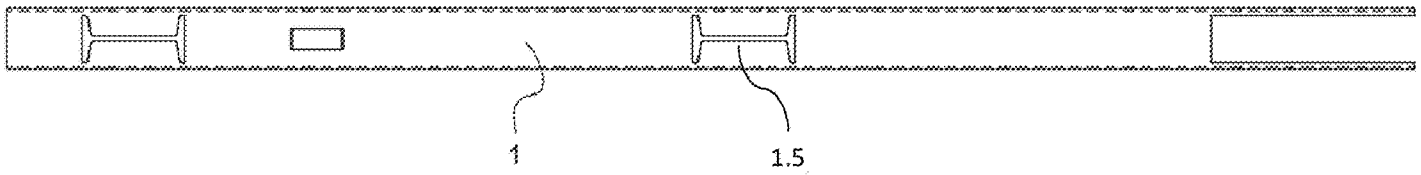
Figure 2E:
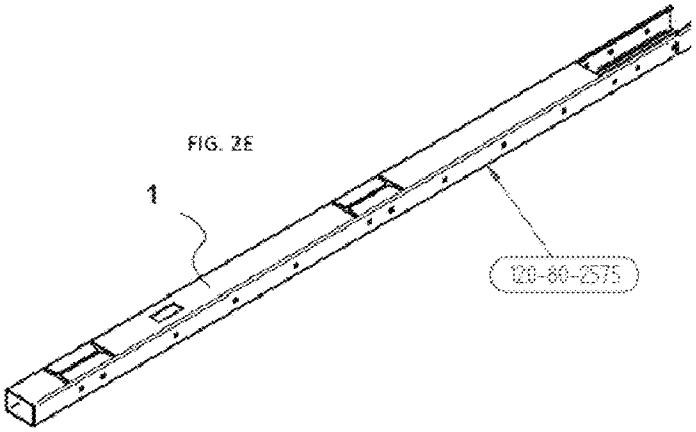
Figure 3A:
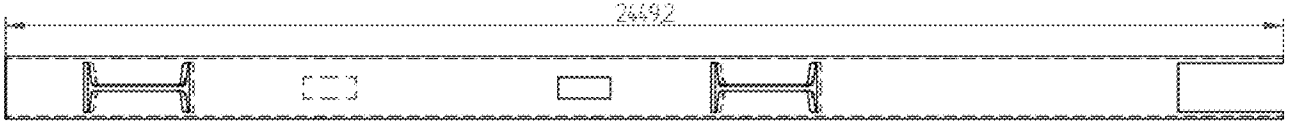
FIGS. 3A-E are various views of a second pylon (5) (120-80-2449) of the arch.
Figure 3B:
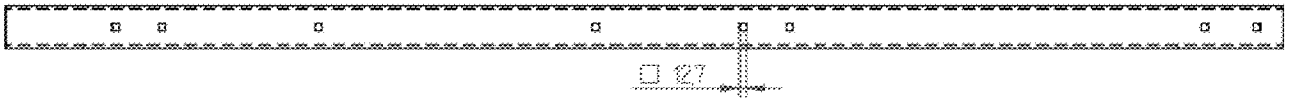
Figure 3C:
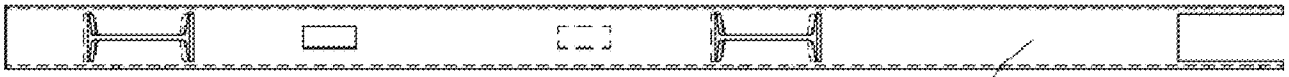
Figure 3D:
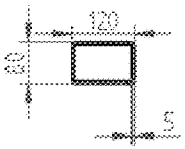
Figure 3E:
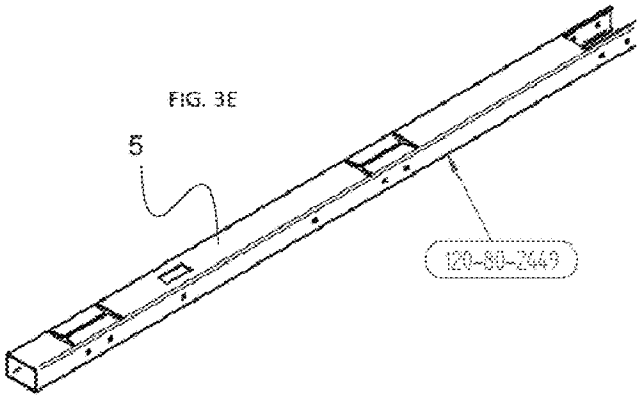
Figure 4A:
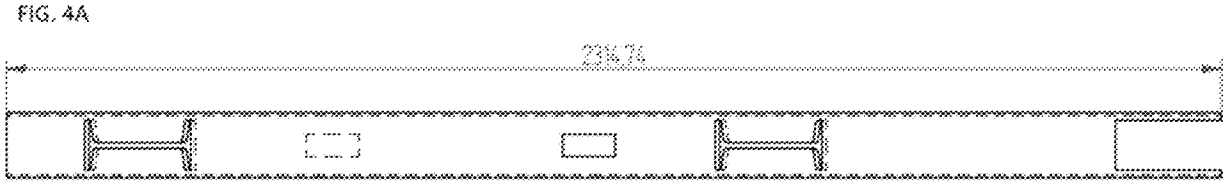
FIGS. 4A-E are various views of a third pylon (6) (120-80-2315) of the arch.
Figure 4B:
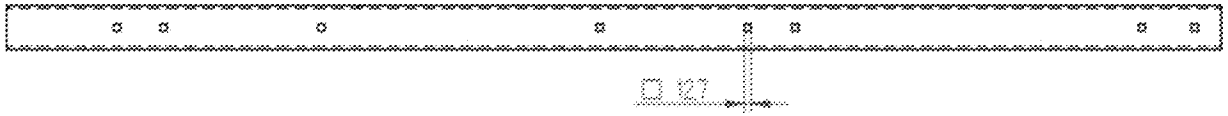
Figure 4C:
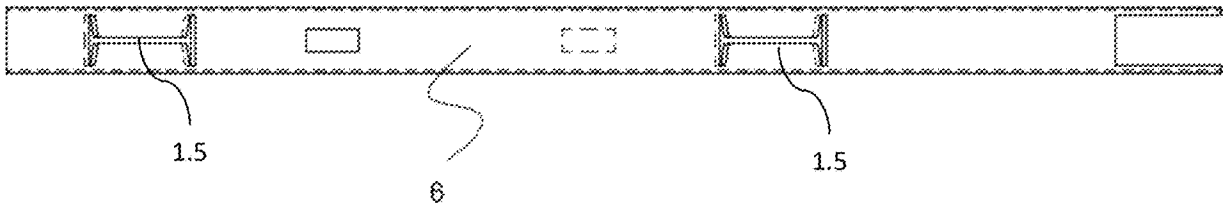
Figure 4D:
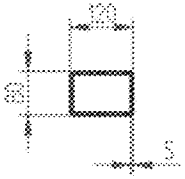
Figure 4E:
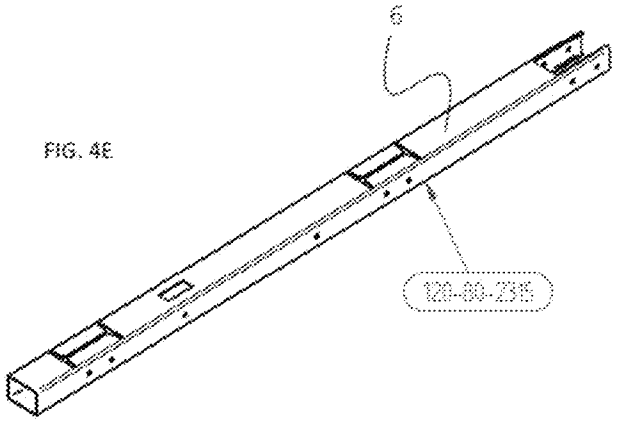
Figure 5A:
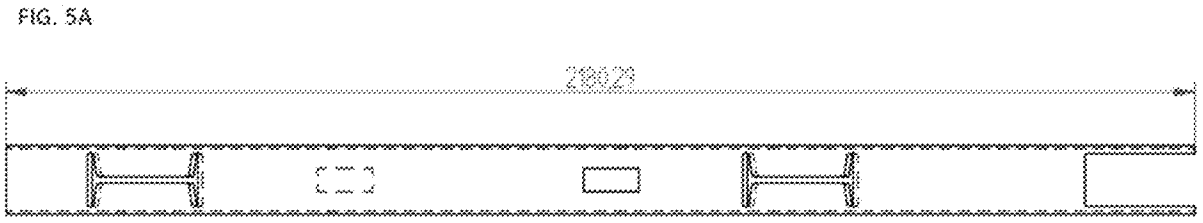
FIGS. 5A-E are various views of a fourth pylon (7) (120-80-2180) of the arch.
Figure 5B:
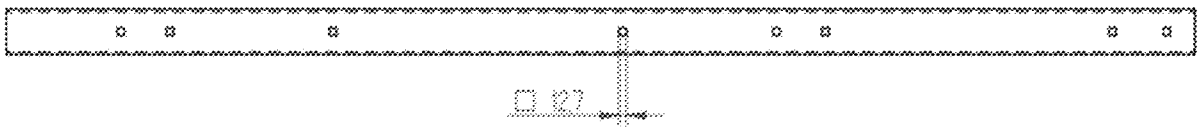
Figure 5C:
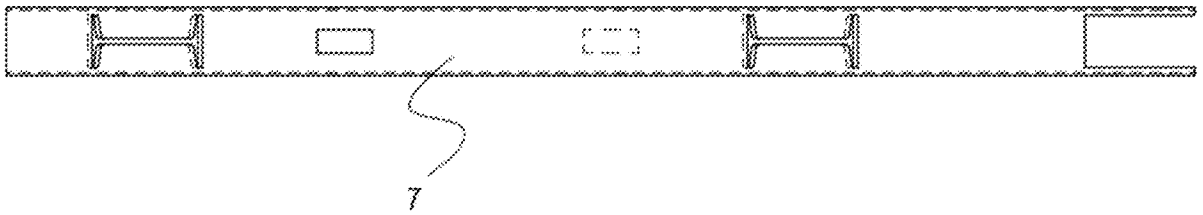
Figure 5D:
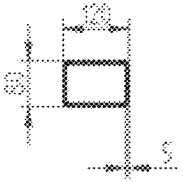
Figure 5E:
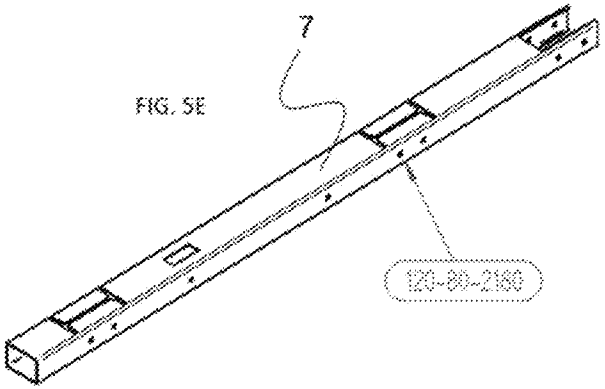
Figure 6D:
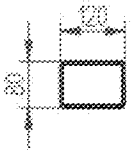
FIGS. 6A-E are various views of a fifth pylon (8) (120-80-2046) of the arch.
Figure 6E:
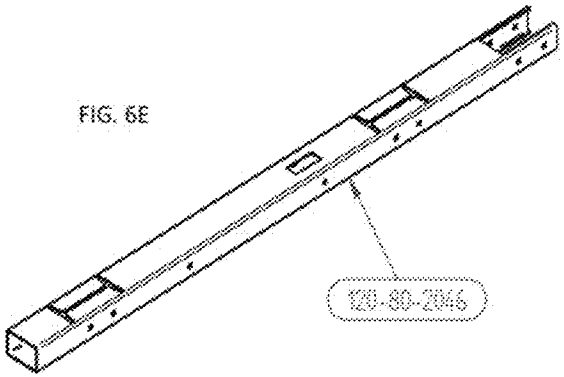
Figure 6A:
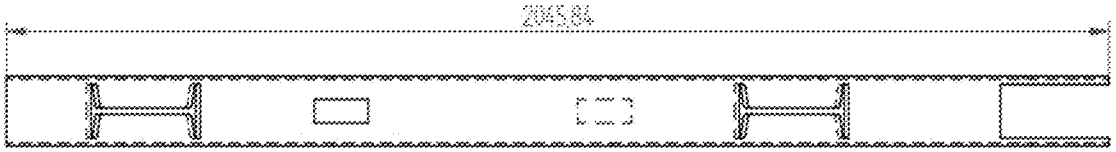
Figure 6B:
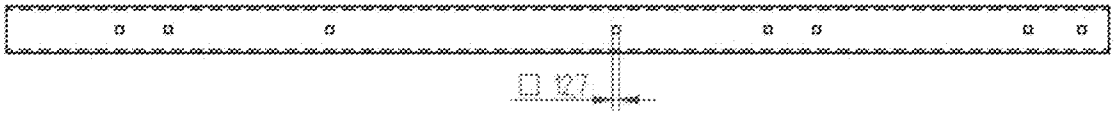
Figure 6C:
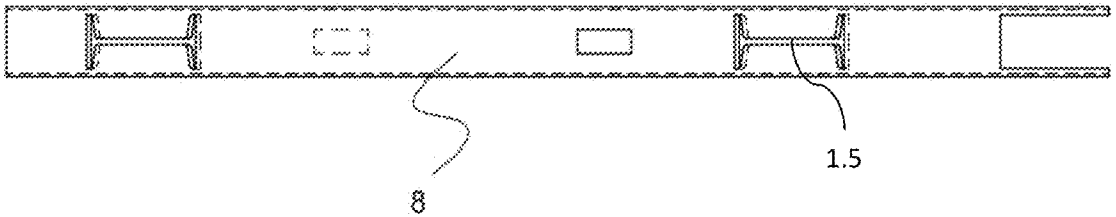
Figure 7D:
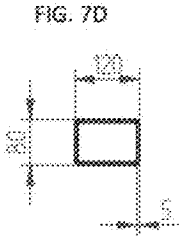
FIGS. 7A-E are various views of a sixth pylon (9) (120-80-1911) of the arch.
Figure 7E:
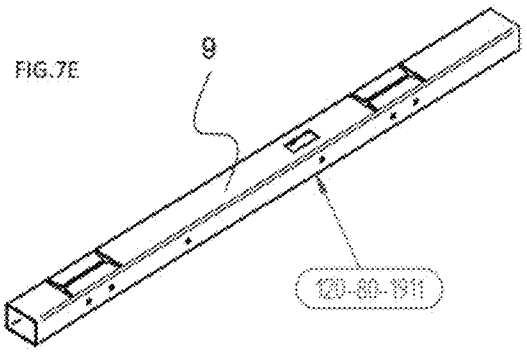
Figure 7A:
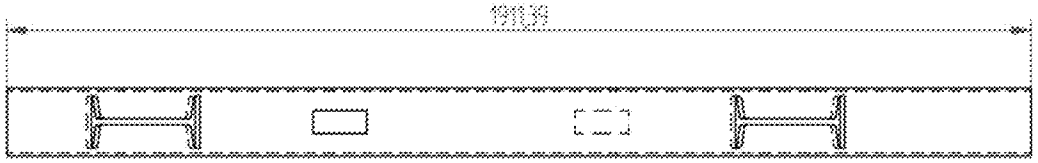
Figure 7B:
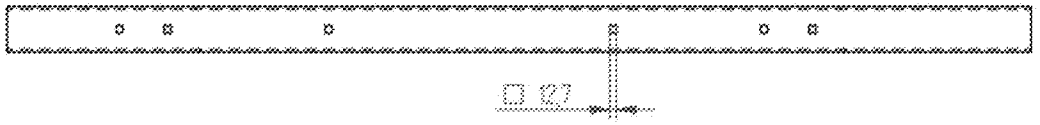
Figure 7C:
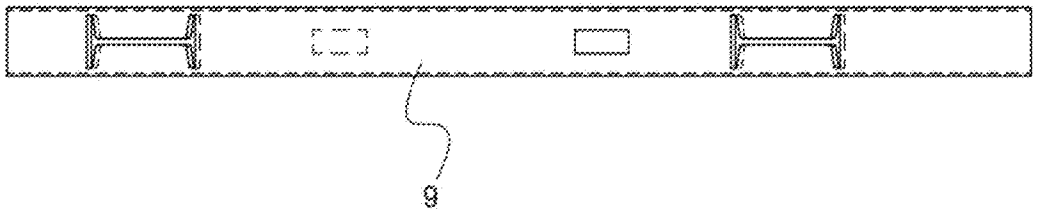
Figure 8E:
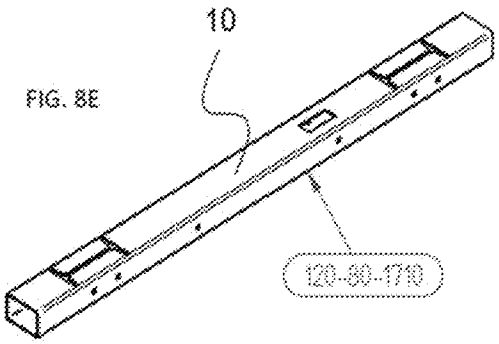
FIGS. 8A-E are various views of a regular pylon (10) (120-80-1710) of the arch.
Figure 8D:
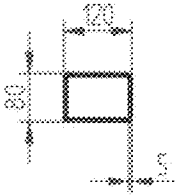
Figure 8A:
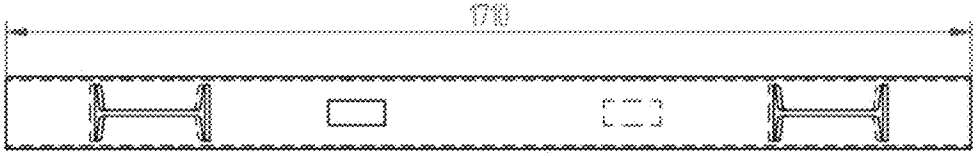
Figure 8B:
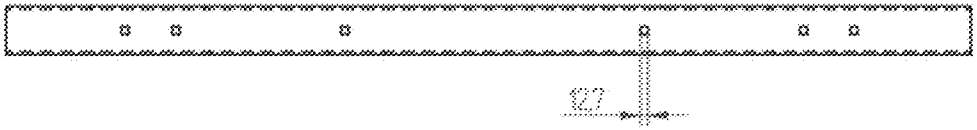
Figure 8C:
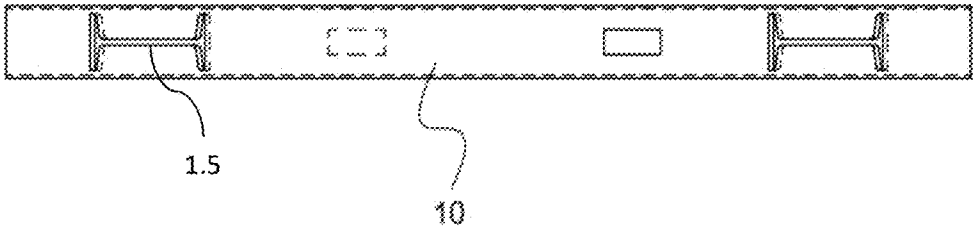

Referring now to the drawings, FIGS. 1A-C illustrate various views of one arch 100 of a metal canopy constructed from a plurality of arches. FIG. 1A is an elevated front isometric view of the arch. FIG. 1A-1 is a magnified view of a portion of FIG. 1A. FIG. 1B is a side view of the arch. FIG. 1B-1 is a magnified view of a portion of FIG. 1B. FIG. 1C is an elevated back isometric view of the arch. Throughout the document, the numbering scheme follows the item numbers and/or file name found on page 1 of the Figures. Where there is a conflict or duplication of the item number, the reference number will be the item name. Quantities of the items appear in the table and are to be seen as if set forth herein for each item. It is made clear that the instant arch is merely exemplary and embodies one optional implementation of the innovative structure.

Innovatively, the instant structure is one of various structures that are assembled from laser cut galvanized steel pieces and fasteners. No changes need to be made to the pieces, leaving the weather-proof finish intact and obviating the need for on-location manipulation of the pieces (i.e., no welding, cutting, bending etc.). The pieces arrive from the factory precut to exact dimensions and galvanized. There is no excessive transportation of materials. Assembly is fast and can be accomplished with a small team of two to four workers. Having no welding on a metal structure of such a size is unheard of. Alternatively, the pieces may be made from other materials, composites, and the like.

FIGS. 2A-E are various views of a central pylon (1) (120-80-2575) of the arch. There are two central pylons that are fixed side by side.

FIGS. 3A-E are various views of a second pylon (5) (120-80-2449) of the arch. There is one second pylon on each side of the central pylon.

FIGS. 4A-E are various views of a third pylon (6) (120-80-2315) of the arch. There is one third pylon next to the second pylon on each side of the central pylon.

FIGS. 5A-E are various views of a fourth pylon (7) (120-80-2180) of the arch. There is one fourth pylon next to the third pylon on each side of the central pylon.

FIGS. 6A-E are various views of a fifth pylon (8) (120-80-2046) of the arch. There is one fifth pylon next to the fourth pylon on each side of the central pylon.

FIGS. 7A-E are various views of a sixth pylon (9) (120-80-1911) of the arch. There is one sixth pylon next to the fifth pylon on each side of the central pylon.

FIGS. 8A-E are various views of a regular pylon (10) (120-80-1710) of the arch. In the instant embodiment, there is 9 pylons lined up next to each other, the first of which is next to the sixth pylon (9) on each side of the central pylon (1).

Figure 9A:
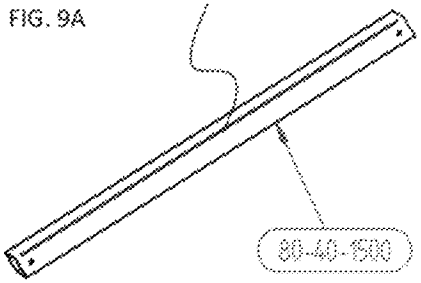
FIGS. 9A-C are various views of a diagonal bar/slanted profile (11) (80-40-1500)
Figure 9C:
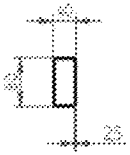
Figure 9B:
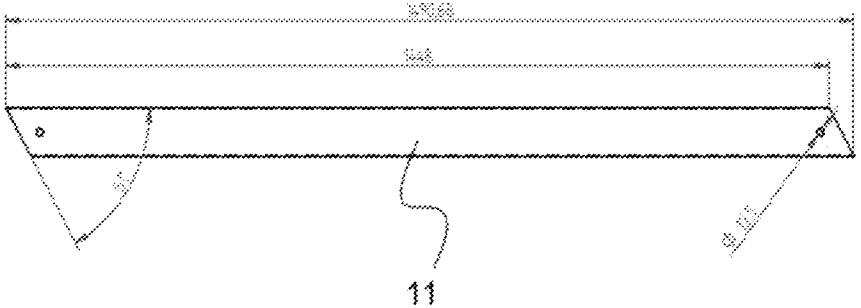

FIGS. 9A-C are various views of a diagonal bar/slanted profile (11) (80-40-1500) of which there are twenty eight (28) in the instant example and where each connects between two adjacent pylons. The diagonal bars are oriented diagonally. The upper end of the slanted profile slots into an opening in a respective pylon and is secured in place with screws at the upper and lower ends.

Figure 10C:
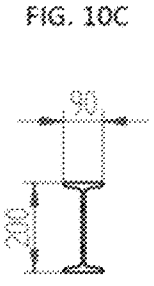
FIGS. 10A-C are various views of horizontal bars (2) (IPN200-12000)
Figure 10B:
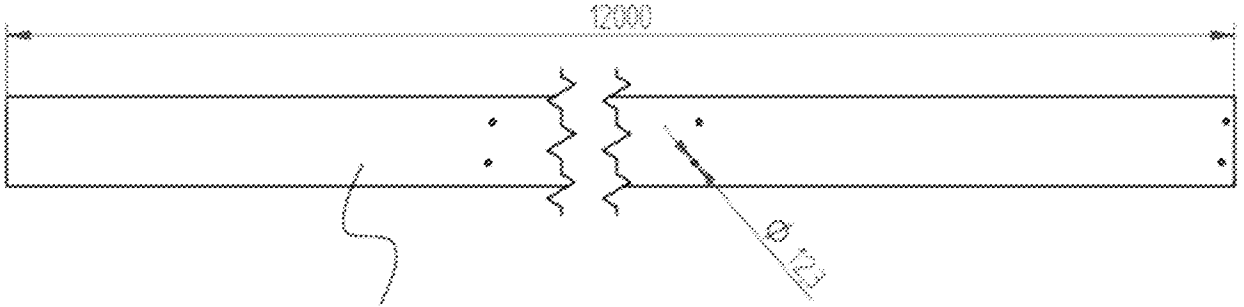
Figure 10A:
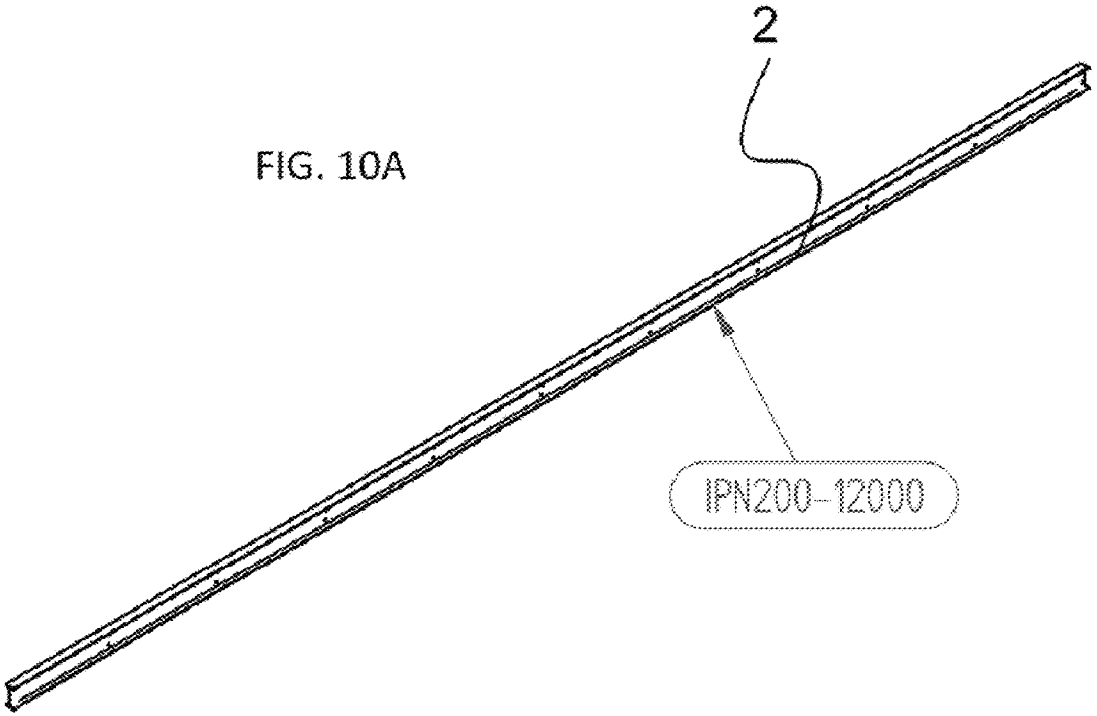

FIGS. 10A-C are various views of horizontal bars or rafter beams (2) (IPN200-12000). There are four rafter beams, two on each side of the central pylon.

Figure 11B:
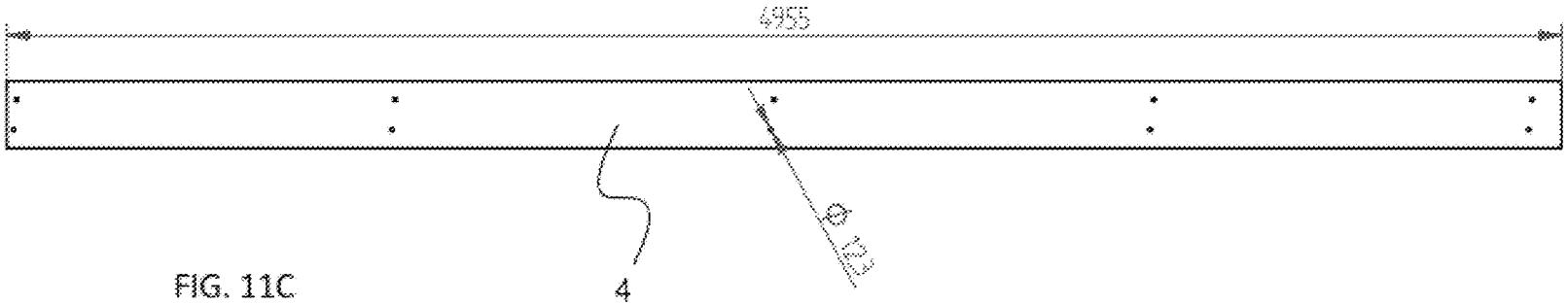
FIGS. 11A-C are various views of extension bars (4) (IPN200-5000) that fit through the lower double-T openings in the last four outer most pylons.
Figure 11C:
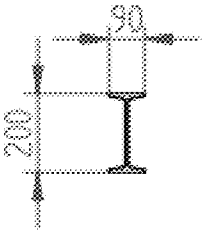
Figure 11A:
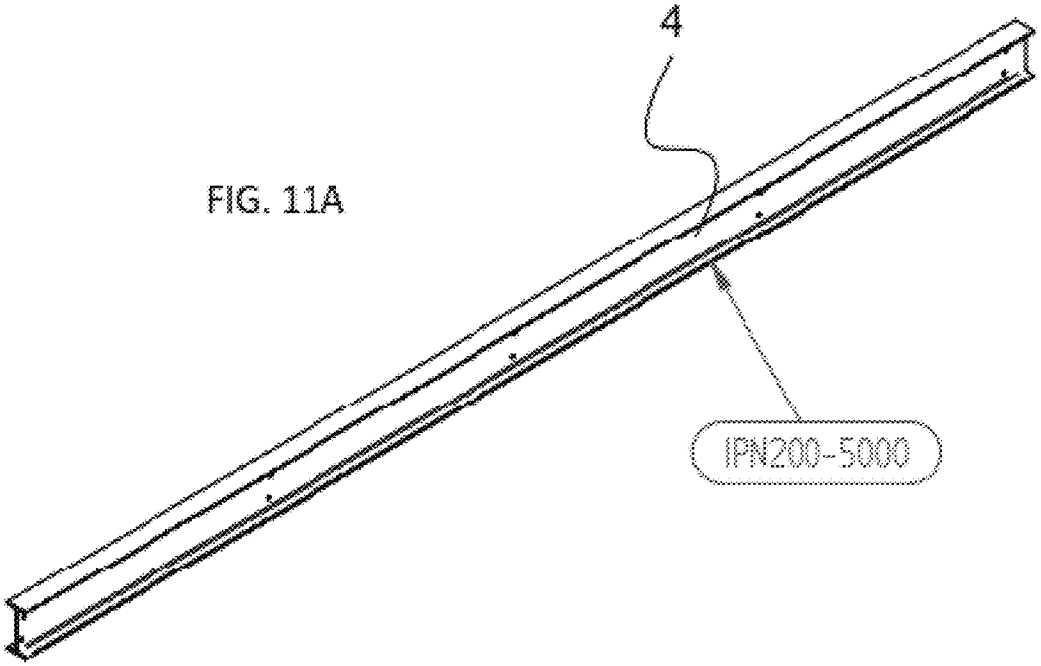

FIGS. 11A-C are various views of extension bars (4) (IPN200-5000) that fit through the lower double-T openings in the last four outer most pylons.

Figure 12C:
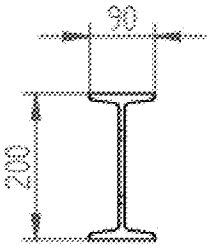
FIGS. 12A-C are various views of extension bars (3) (IPN200-6000) that fit through the upper double-T openings in the last four outer most pylons.
Figure 12B:
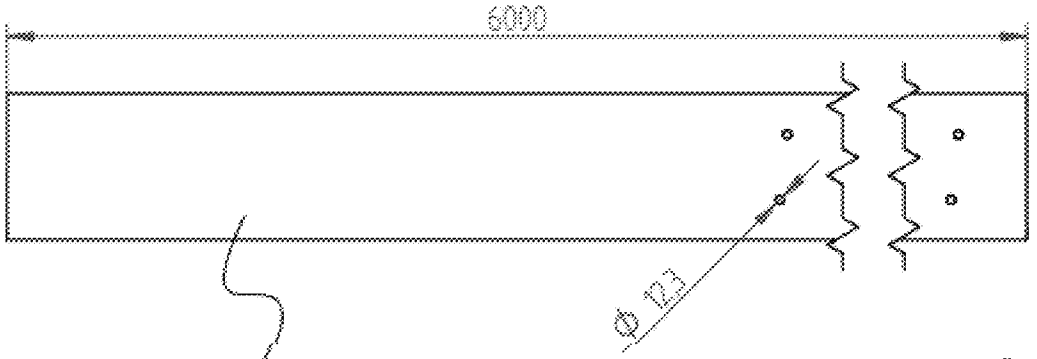
Figure 12A:
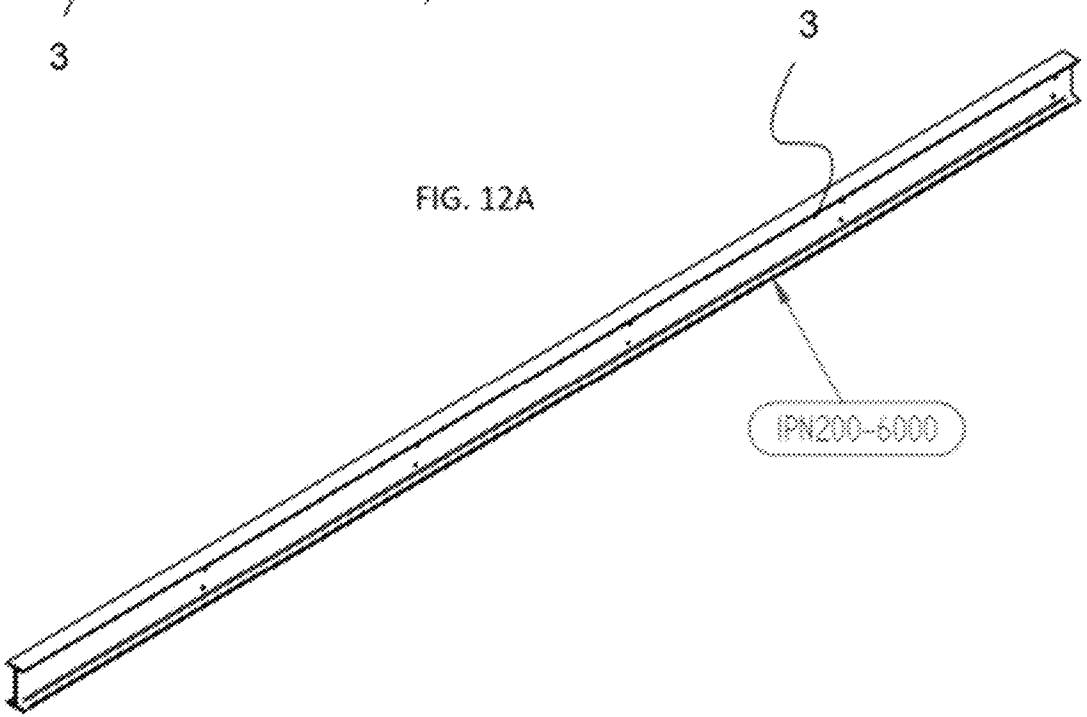

FIGS. 12A-C are various views of extension bars (3) (IPN200-6000) that fit through the upper double-T openings in the last four outer most pylons.

Figures 13A, 13B, 13C:
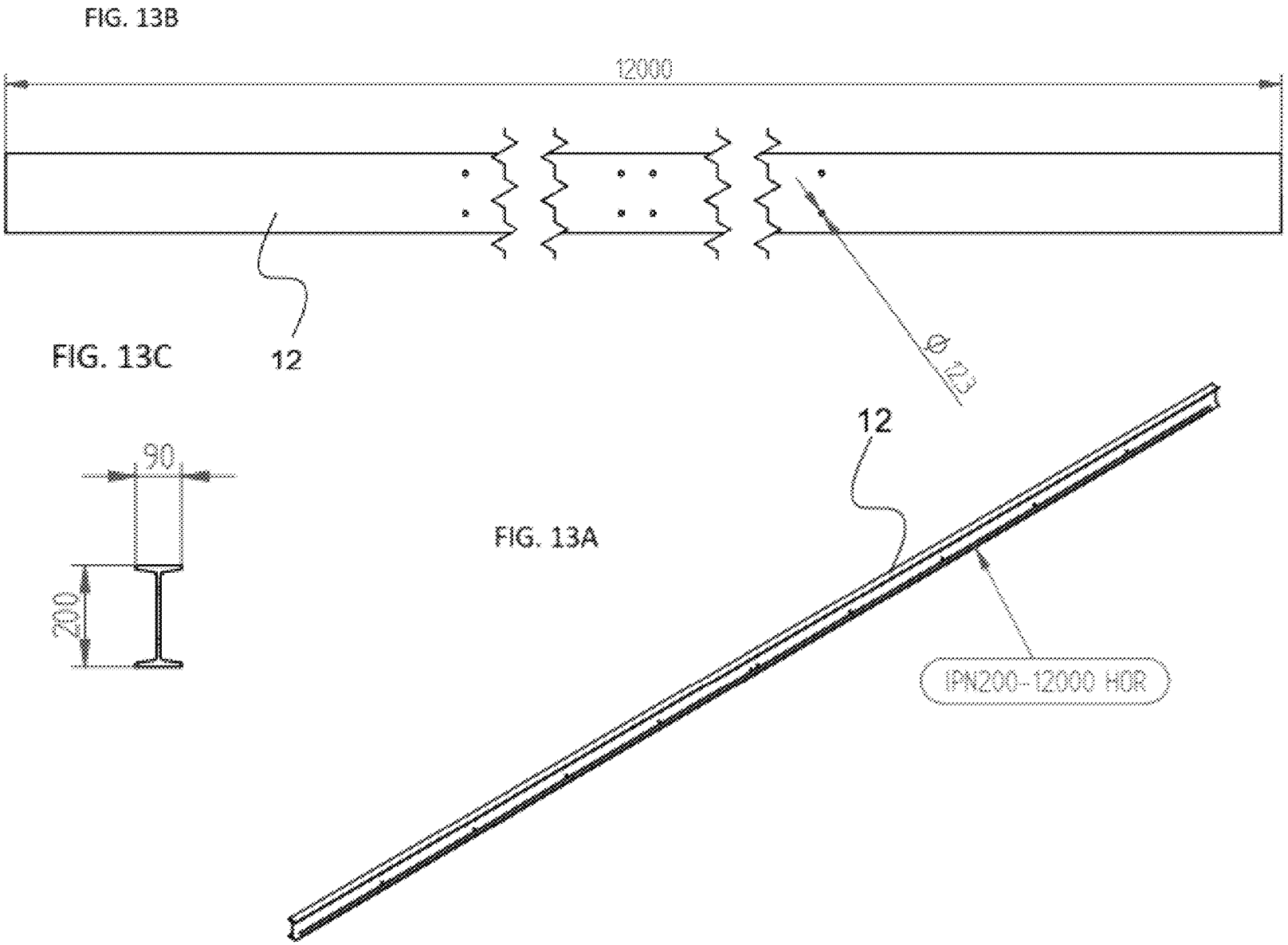
FIGS. 13A-C are various views of bottom bars (12) (IPN200-12000 HOR)

FIGS. 13A-C are various views of an apex bar (12) (IPN200-12000 HOR) that fits through the bottom openings of the central to fifth pylons on each side of the central pylons.

Figure 16C:
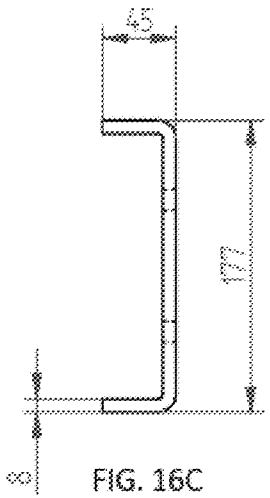
FIGS. 16A-C are various views of holder (15) (holder 1 120-80)
Figure 16A:
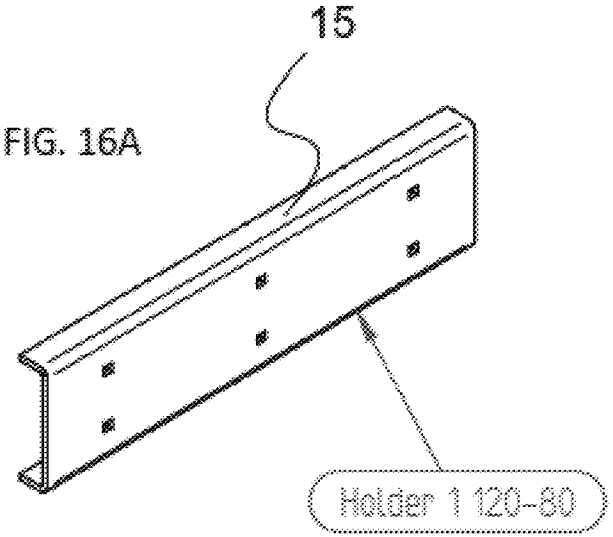
Figure 16B:
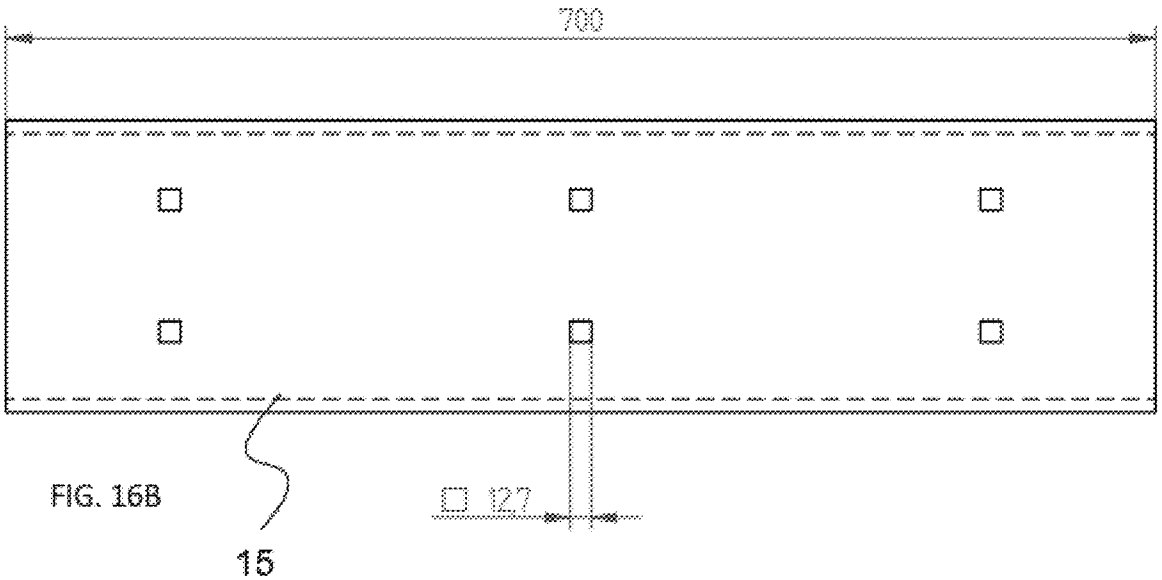

FIGS. 16A-C are various views of holder (15) (holder 1 120-80). There are four holders (15) which are used to attach the central pylons together along two locations on the pylons. The holders 15 are metal holder plates that are aligned on the front and back of the arch and secured together with screws, sandwiching the pylons therebetween.

Figure 17A:
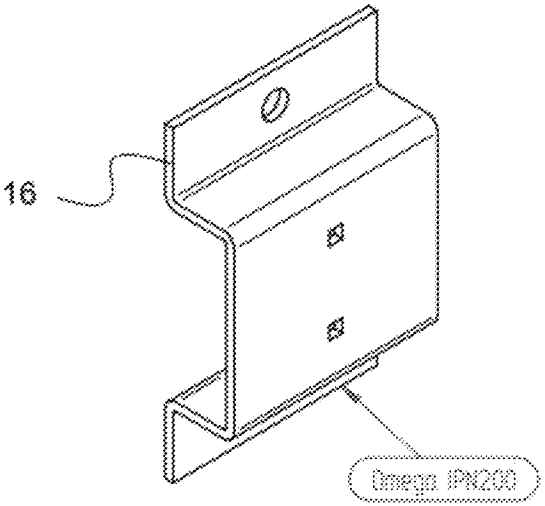
FIGS. 17A-C are various views of omega (16) (Omega IPN200)
Figure 17C:
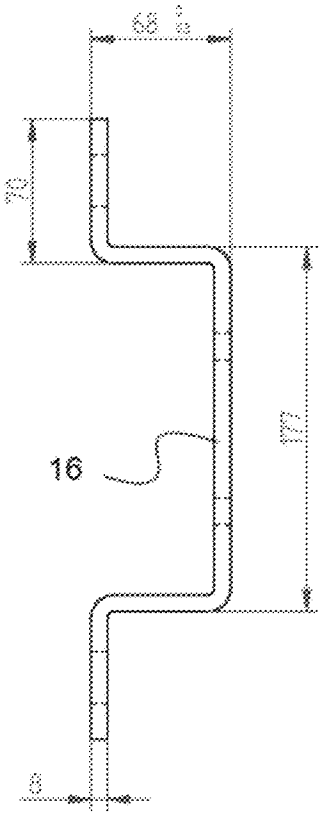
Figure 17B:
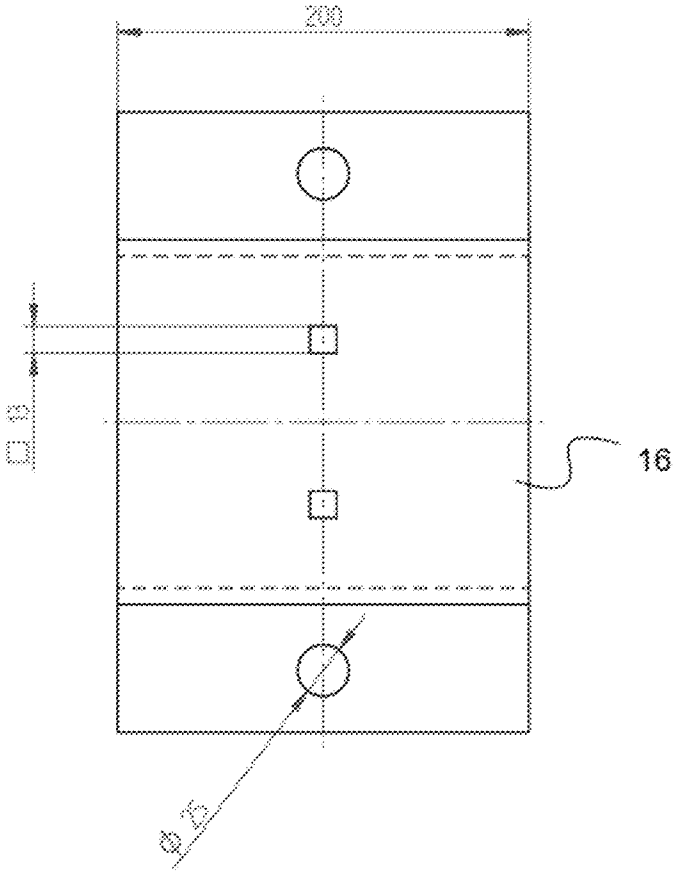

FIGS. 17A-C are various views of omega (16) (Omega IPN200). Two omegas (16) are attached together at the bottom of the central pylons.

Assembly

No welding is necessary in the entire construction of the metal canopy. This is true for all the structures mentioned herein. Even structures that are described as having a single welding point can be replaced with components that do not require welding (as discussed elsewhere).

There is disclosed a rigid portal frame structure which is a single-story building made of steel with interconnecting beams and columns. The structure has a straightforward design, lightweight components, and the added benefit of having all its elements prefabricated for easy on-site assembly. These features make it ideal for various structures, including industrial and commercial warehouses, workshops, storage facilities, poultry buildings, and aircraft hangars. The instant structure is in the single-span category. The roof section of the frame is made up of two or more rigid "arches", depending on the building length (the example prior art canopy has five arches). Interior rigid arches, together with vertical columns, are designed to support half of each adjacent bay. The interval between each rigid frame is called "bay spacing".

Each "arch" is made up of two rafter constructions, one on each side of a central vertical column. Each "rafter" is made up of an upper beam and a lower beam with vertical profile between the beams and slanted profiles interposed between the vertical profiles. An "apex brace" (also referred to herein simply as a "brace") underpins the arch.

At the center of the arch 100 are two vertical profiles, each referred to herein as a central pylon 1 (FIGS. 2A-2E), with the wide surfaces of the profiles placed together. Four holders 15 (FIGS. 16A-16C) secure the central pylons (1) together. Two Omega 16 pieces are coupled together at the bottom, open ends (on the right side of the depicted figures) of the central pylons (1).

The central pylons, and indeed all the pylons, have two I-shaped openings (1.5) for I-beams, disposed in the wide surfaces of the pylon. All I-shaped openings are similarly referenced (1.5). Square openings are disposed on the narrow surfaces of the pylons. Preferably, the type of fastener used is a screw called a carriage bolt (also called a coach bolt or round head square neck bolt). A carriage bolt is distinguished from other bolts by its shallow mushroom head and that the shank cross-section of the bolt is circular for most of its length, as usual, but the portion immediately beneath the head is formed into a square section. The square section fits inside the square openings. The circular, threaded end of the screw is preferably flat ended to receive a nut. As mentioned, this description regarding the I-beams/I-shaped openings applies equally to pylons 5 to 10, discussed below. The description regarding the square holes applies to all the parts having such.

As mentioned above, each "rafter" of the left and right rafters includes the following: two beams 2 (FIGS. 10A-10C), an upper beam 2 and a lower beam 2. In total, there are four rafter beams 2. The rafter beams are actually canted at an angle as is clear from the depiction in FIG. 1A. The rafter beams (2) each have a "double-T" cross-section—like two T's arranged foot to foot—referred to hereafter as being I-beam-shaped. The term I-beam is limited to the depicted form in the Figures and the descriptions in this document. The rafter beams fit through corresponding openings in the pylons. The pylons and beams are fixed together with carriage bolts that are fit through corresponding holes.

Each rafter beam (2) fits through the ten pylons closest to the center: central pylon, second pylon 5, third pylon 6, fourth pylon 7, fifth pylon 8, and sixth pylon 9 (FIGS. 2A-7E) and four of the regular pylons 10 (FIGS. 8A-E). To clarify, the upper rafter beam 2 fits through the upper double-T openings (1.5) and the lower rafter beam 2 fits through the lower double T/I-shaped openings (1.5) in the pylons.

The one rafter (either the left one or the right one) is further made up of extension bars that are aligned with the rafter beams 2. One extension bar (4) (IPN200-5000) fits through the lower double-T/I-shaped openings in the last four outer most pylons 10 (FIGS. 11A-11C). One extension bar (3) (IPN200-6000) fits through the upper double-T/I-shaped openings in the last four outer most pylons 10.

Fourteen diagonal bars or slanted profiles 11 (FIGS. 9A-9C) are disposed between every two pylons, on a diagonal, and fixed in place by screws. The upper end of the slanted profile slots into an opening in a respective pylon and is secured in place with screws at the upper and lower ends.

A mirror image assembly is found on the second rafter, on the other side of the central pylons.

The apex brace/bar 12 (FIGS. 13A-13C) fits through the bottom openings of the central to fifth pylons 6-8 on each side of the central pylons 1 and is fixed in place by screws. The apex brace 12 is an I-beam shaped metal profile.

Figure 14C:
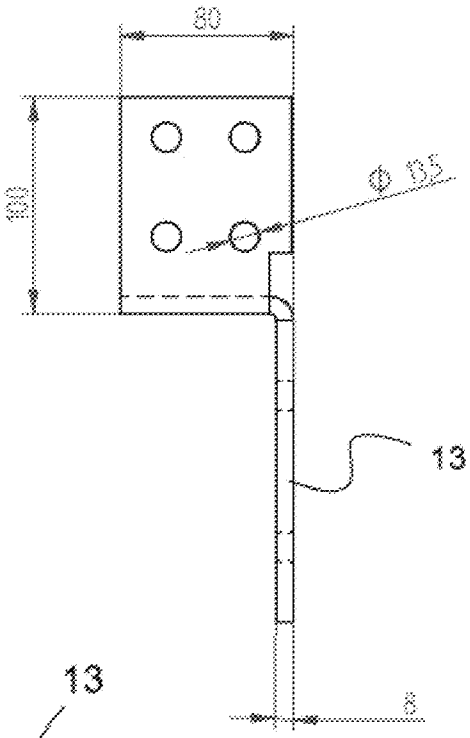
FIGS. 14A-C are various views of a holder 120 (13)
Figure 14A:
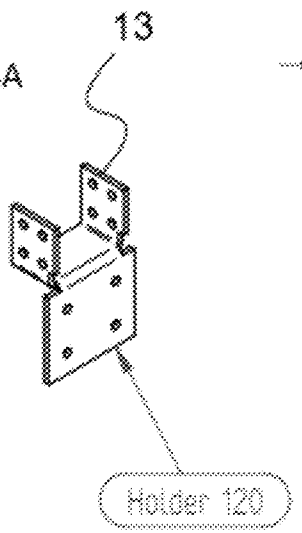
Figure 14B:
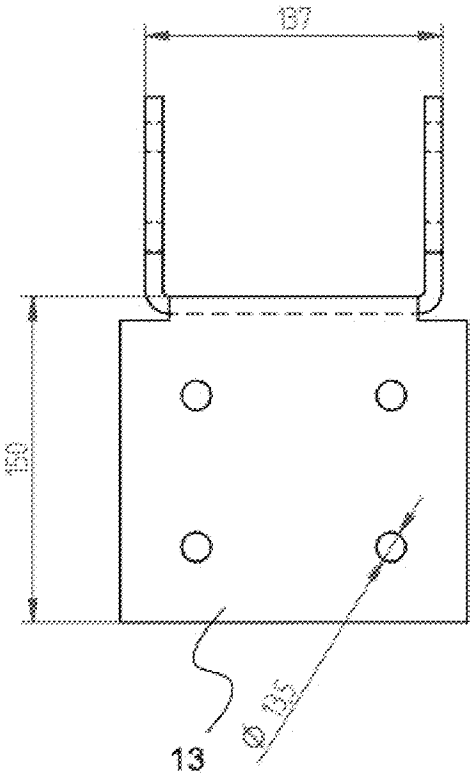

FIGS. 14A-C are various views of a holder 120 (13). There are two holders 120 (13) affixed to the bottom ends of the outermost regular pylons.

Figure 15C:
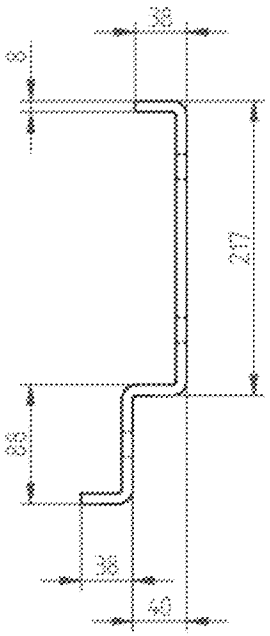
FIGS. 15A-C are various views of holder IPN200 (14)
Figure 15A:
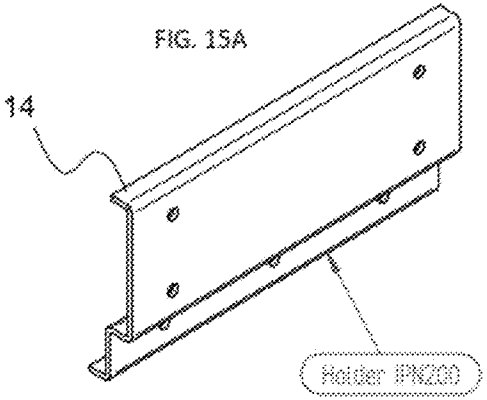
Figure 15B:
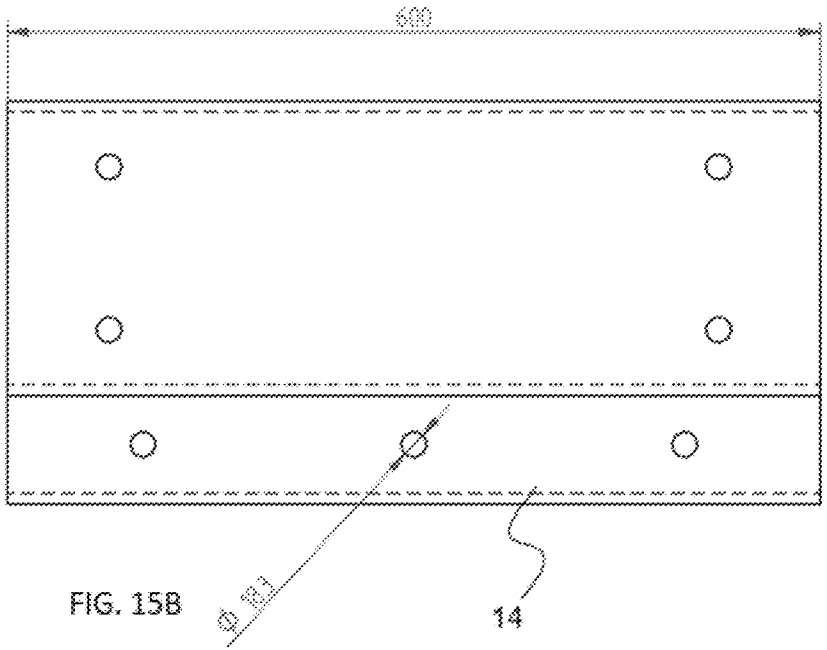

FIGS. 15A-C are various views of holder IPN200 (14). There are four holder IPN200*s*, two attached to the middle of each of the outermost pylons.

A crane lifts the arch and places it on the support columns. Alternatively, the support columns can be attached to the arch prior to being raised by a crane and placed in the ground supports (e.g., poured concrete). The process is repeated for each arch.

The arches are connected by purlins (disposed along the Z-axis), as in the prior art canopy 700. The purlins may rest on, and be attached to, the protruding tops of the pylons. Details from the prior art canopy are applicable, mutatis mutandis, to the instant embodiment as detailed heretofore.

All of the measurements provided in the drawings are in millimeters and should be seen as if presented herein fully. It is to be appreciated that the measurements are merely exemplary, and not limiting.

Figures 1, 18A:
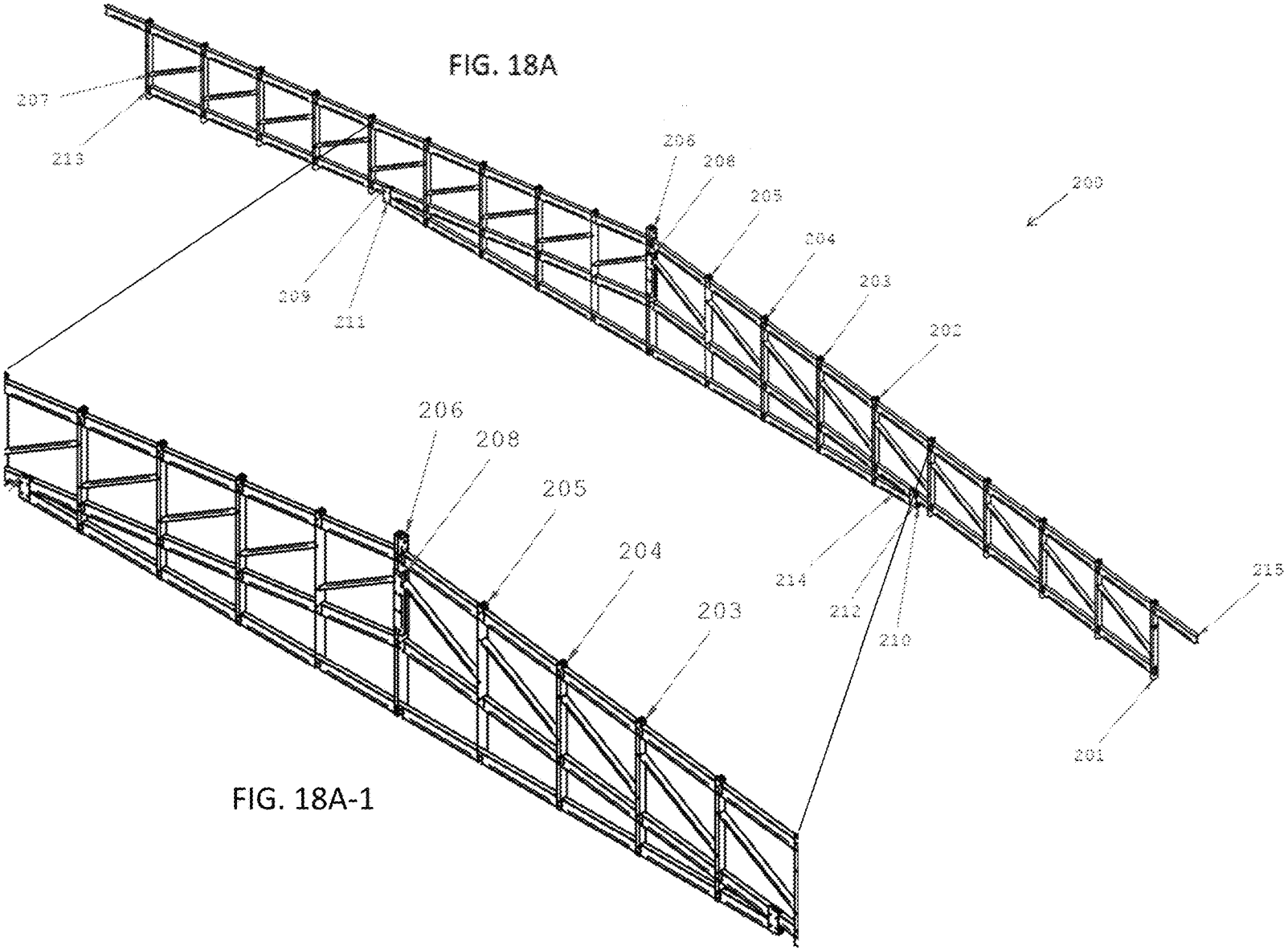
FIGS. 18A and 18B are isometric and front views of another configuration of an "arch" 200 used for a metal canopy of a rigid portal frame structure.
Figures 1, 18B:
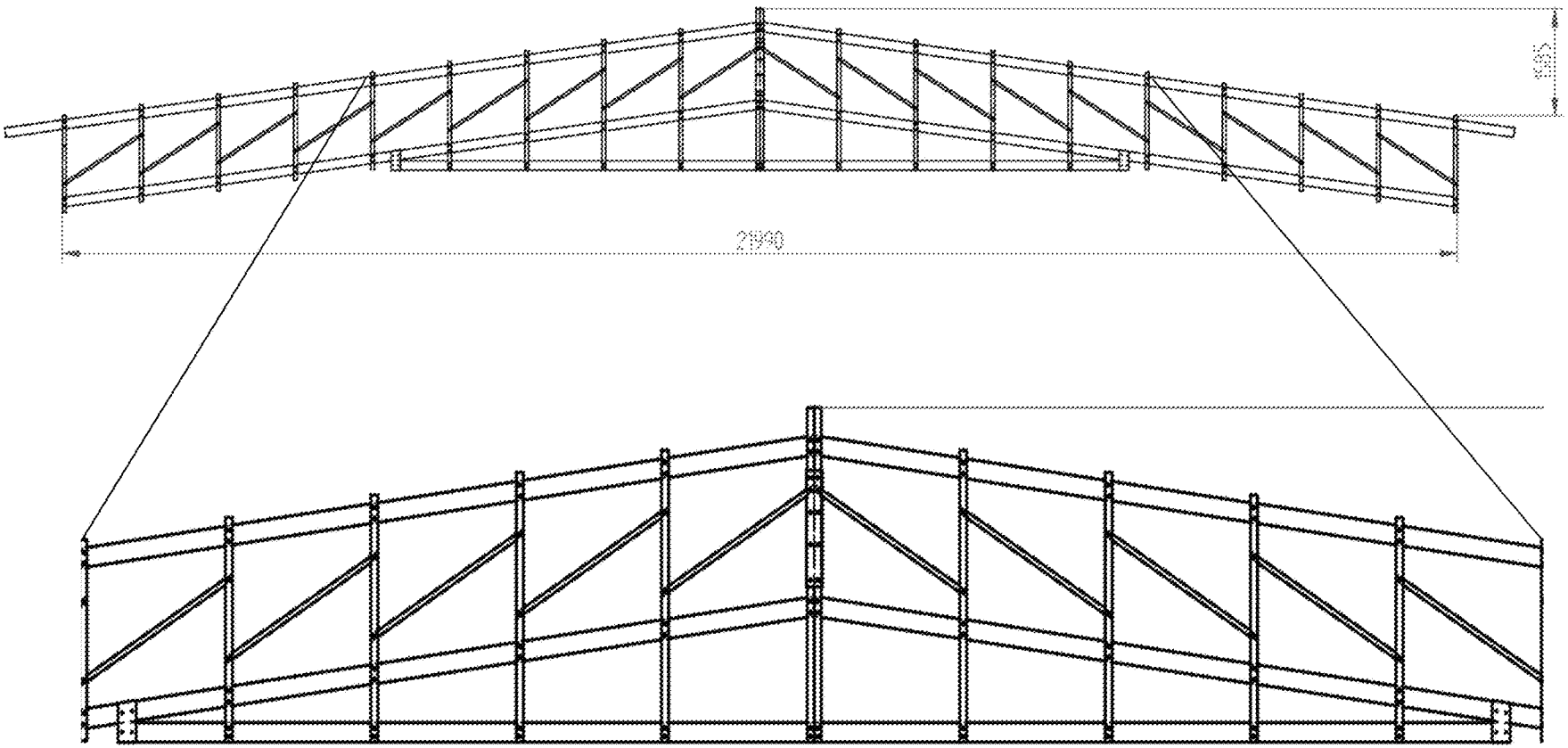
Figures 19A, 19B, 19C, 19D, 19E:
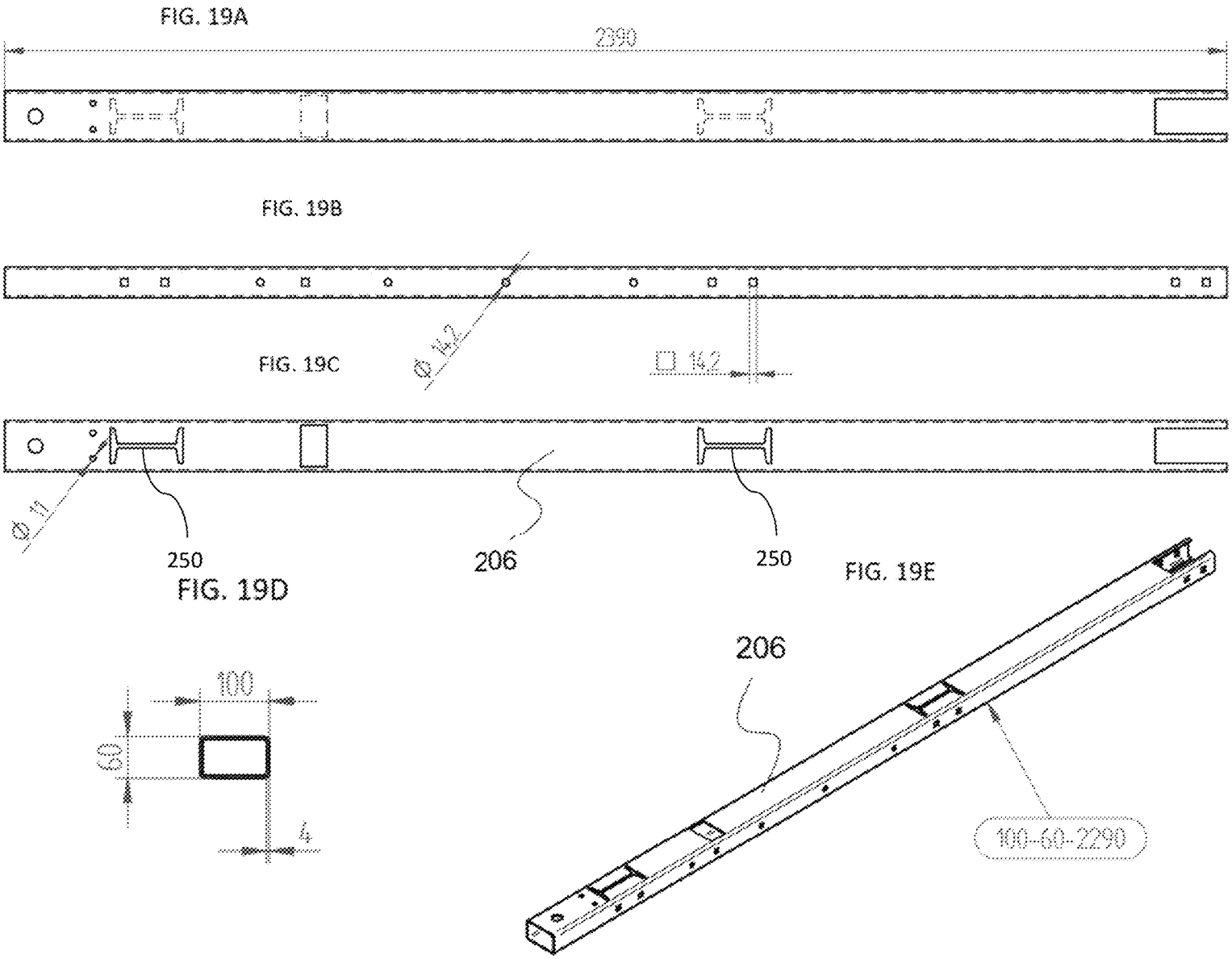
FIGS. 19A-19E are various views of a central pylon 206.
Figure 20A:
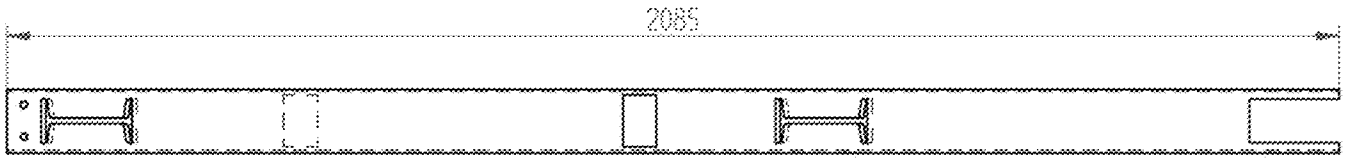
FIGS. 20A-20E are various views of a second pylon 205.
Figure 20B:
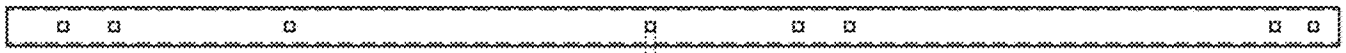
Figure 20C:
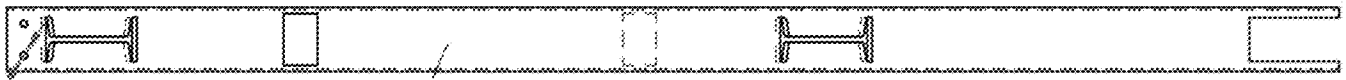
Figure 20D:
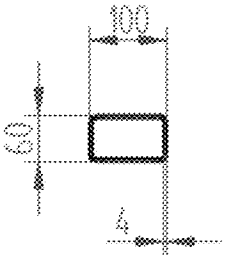
Figure 20E:
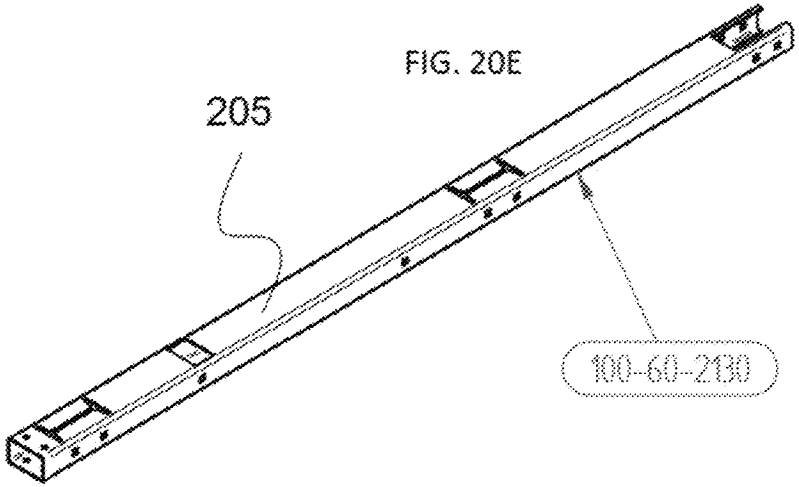
Figure 21A:
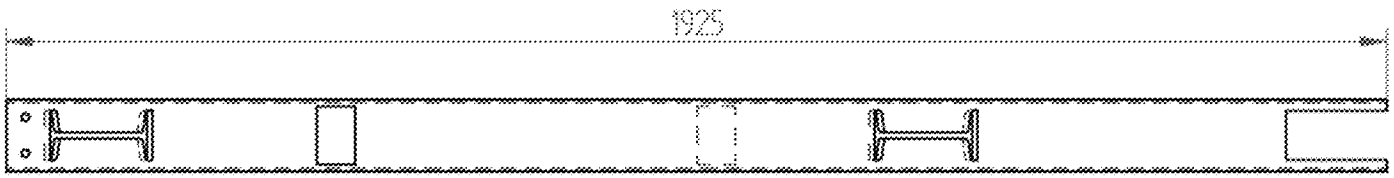
FIGS. 21A-21E are various views of a third pylon 204.
Figure 21B:
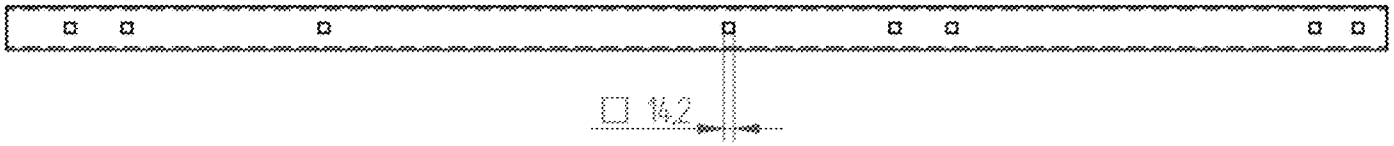
Figure 21C:
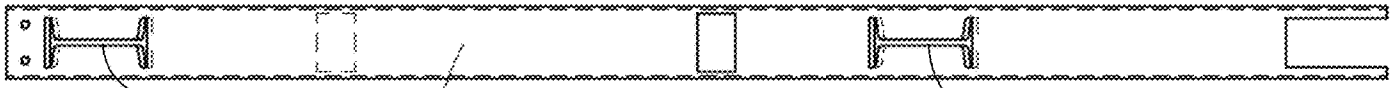
Figure 21E:
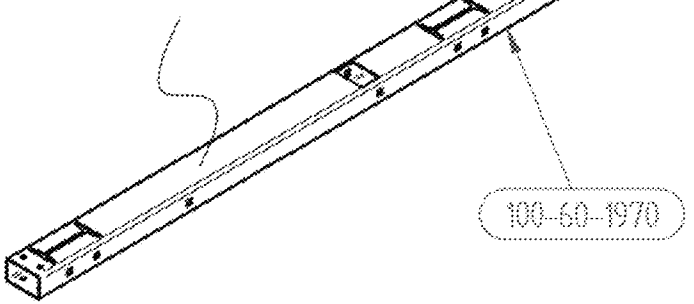
Figure 21D:
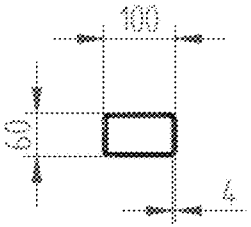
Figures 22A, 22B, 22C, 22D, 22E:
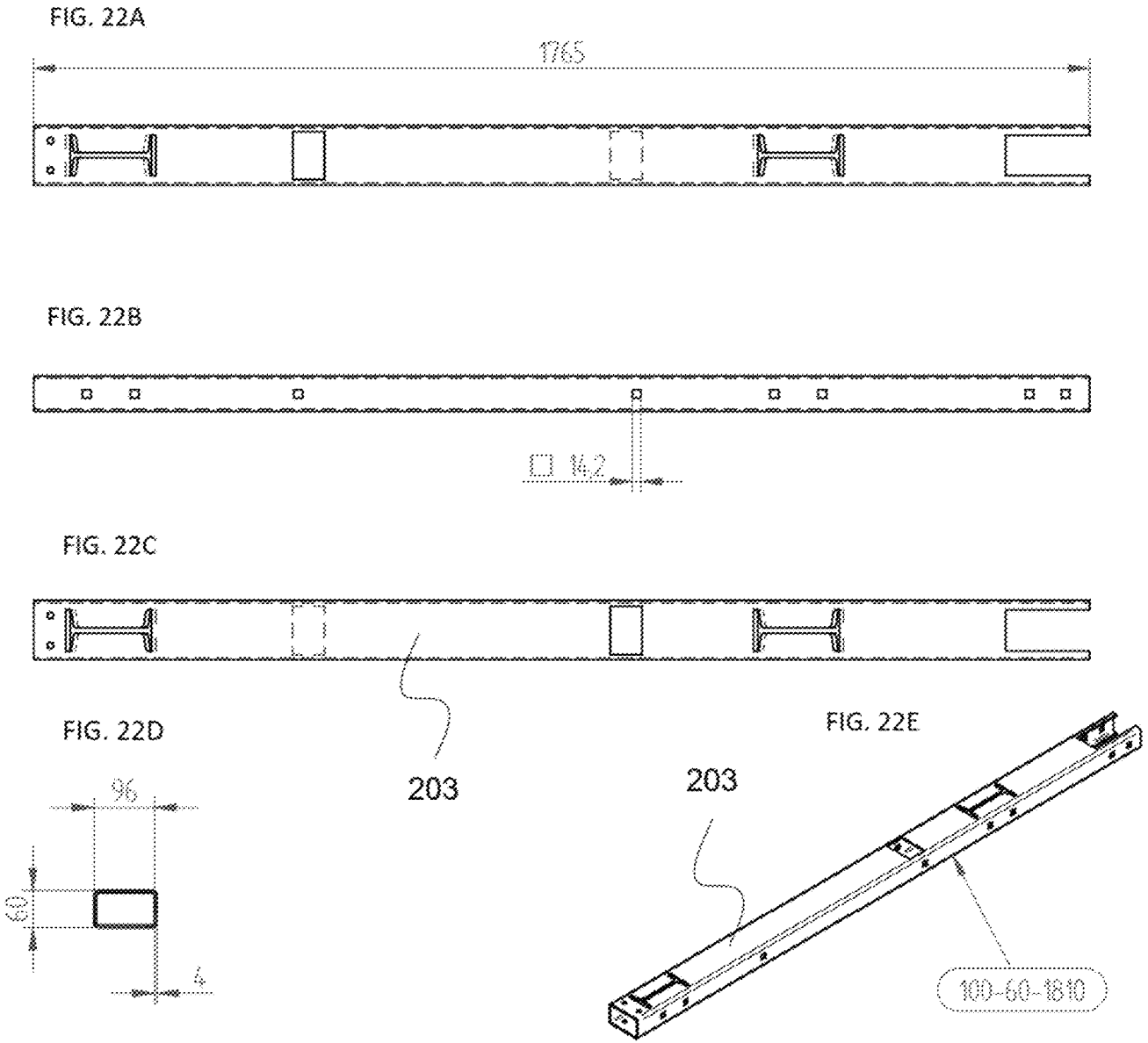
FIGS. 22A-22E are various views of a fourth pylon 203.
Figures 23A, 23B, 23C, 23D, 23E:
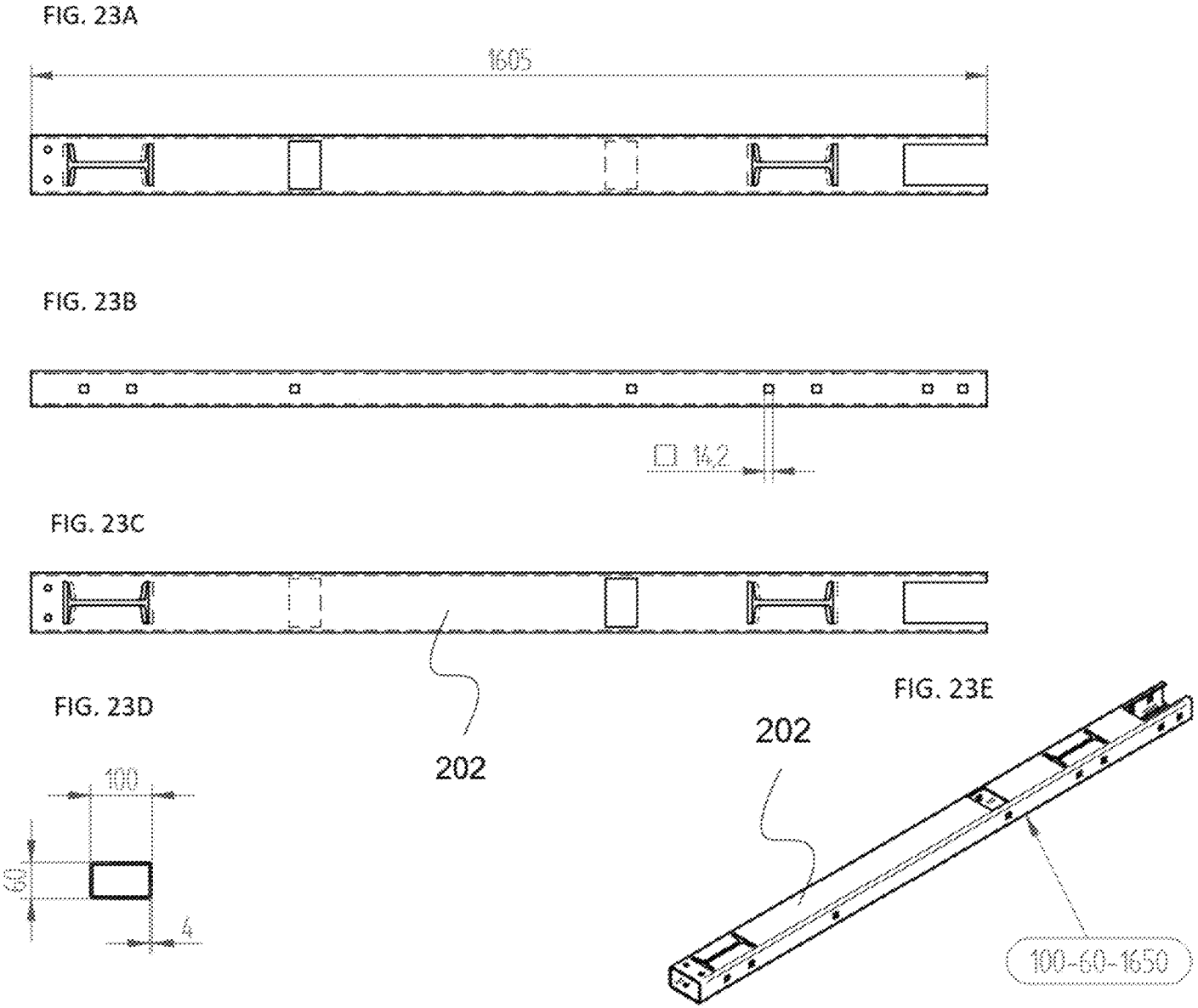
FIGS. 23A-23E are various views of a fifth pylon 202.
Figure 24A:
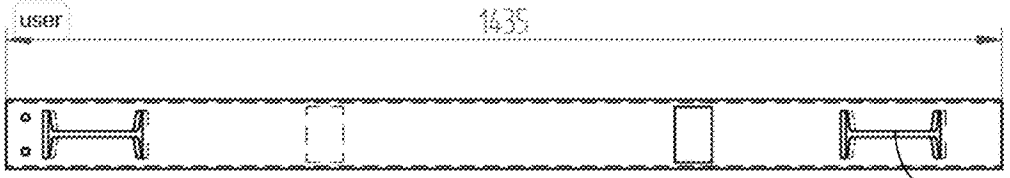
FIGS. 24A-24E are various views of a regular pylon 201.
Figure 24B:
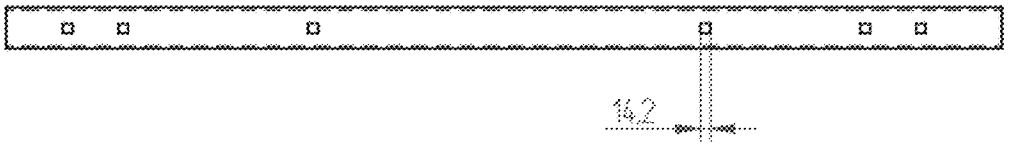
Figure 24C:
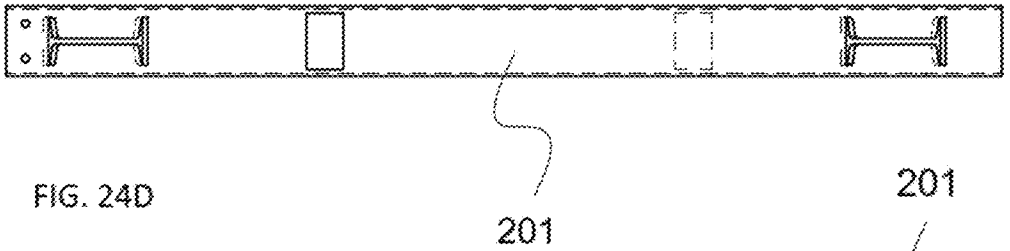
Figure 24E:
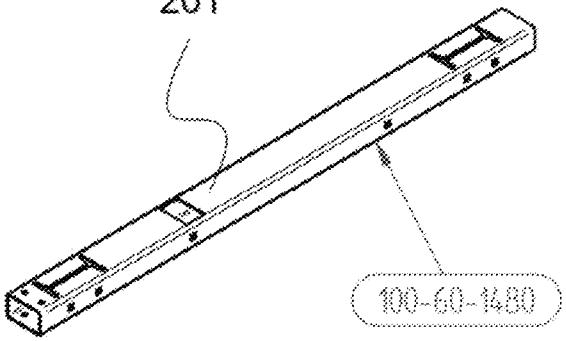
Figure 24D:
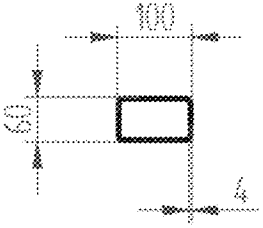

Another possible configuration is shown in FIGS. 18A-30C. FIGS. 18A and 18B are isometric and front views of another configuration of an "arch" 200 used for a metal canopy of a rigid portal frame structure. FIG. 18A-1 is a magnified view of a portion of FIG. 18A. FIG. 1B-1 is a magnified view of a portion of FIG. 1B.

The manner of assembly of the arch would be clear to one skilled in the art, based on the description of the arch 100 detailed above.

FIGS. 19A-19E are various views of a central pylon 206. The current embodiment includes two central pylons 206 (100-60-2290). Each central pylon 206 has one upper and one lower double-T/I-shaped opening 250 disposed on the wide surface of the pylon and an open bottom end. All double-T/I-shaped opening 250 are similarly referenced. The central pylons 206 are coupled together, wide surface to wide surface, and secured with two holders 208 (Holder C IPN140) bolted on the front and back sides of the central pylons.

Figure 30A:
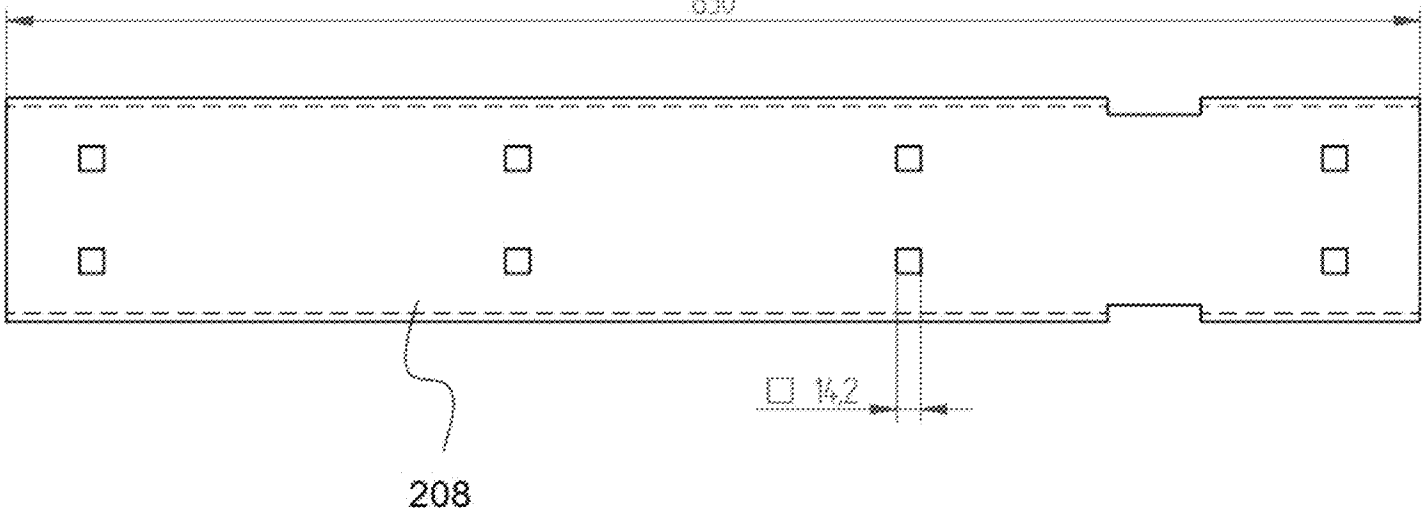
FIGS. 30A-30C are various views of holder 208.
Figure 30C:
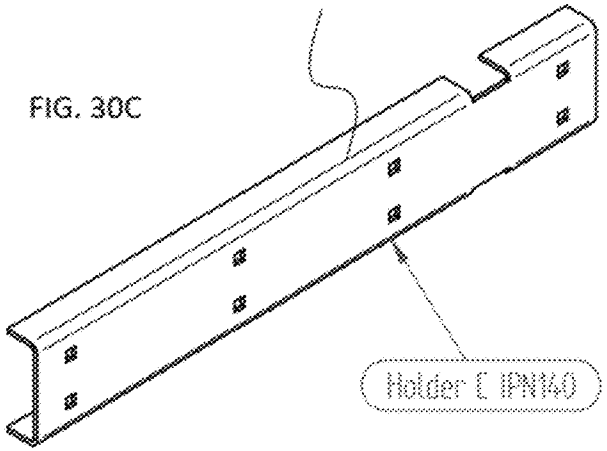
Figure 30B:
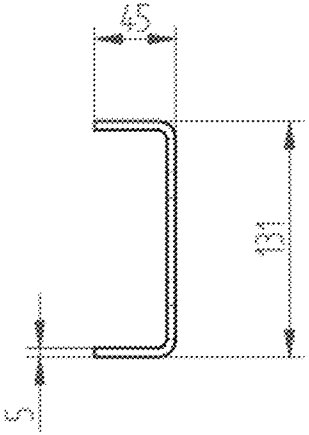
Figure 31:
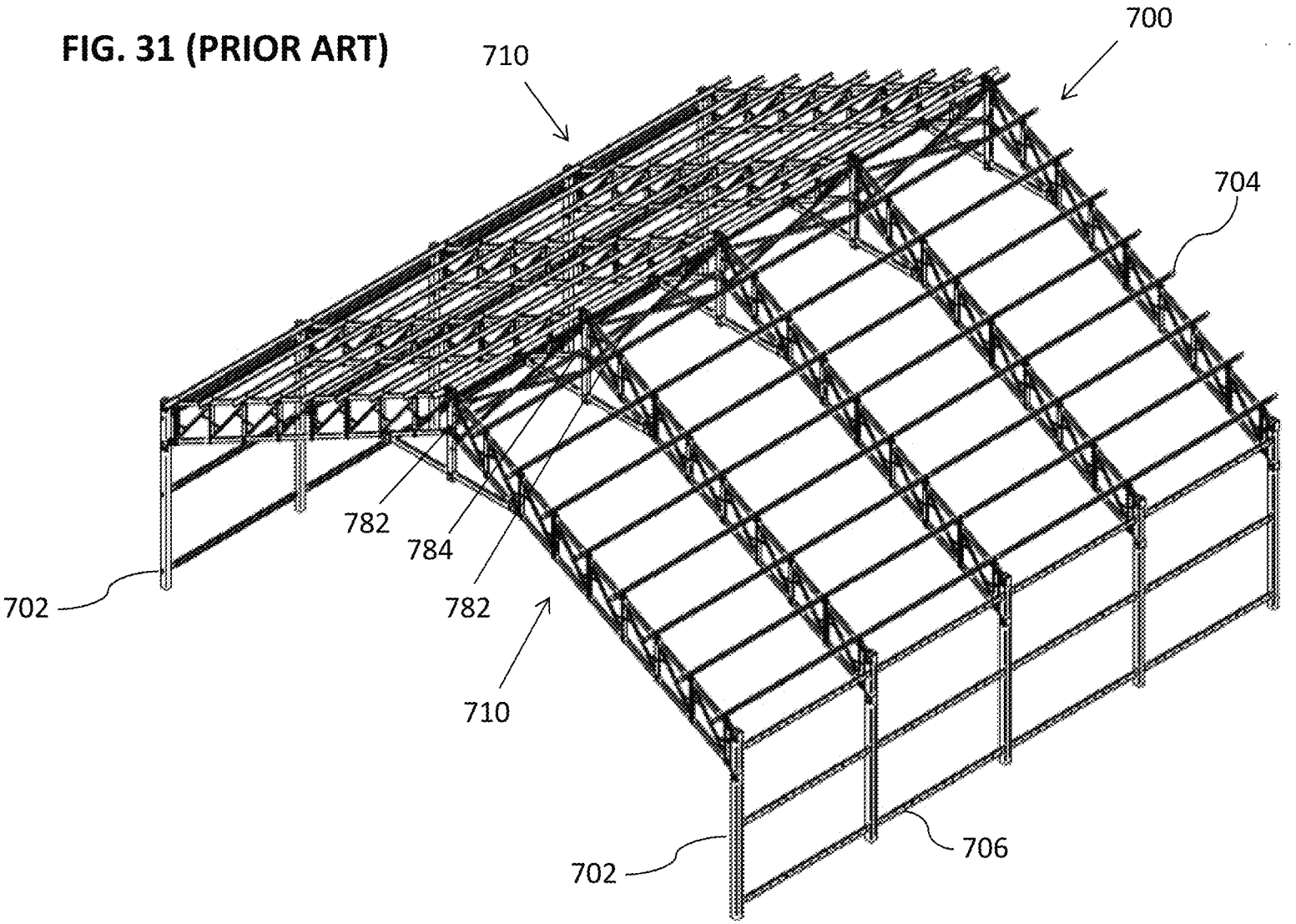
FIG. 31 (PRIOR ART)
FIG. 31 is an isometric view of a prior art metal canopy structure.

FIGS. 30A-30C are various views of holder 208. There are two holders 208 in the instant embodiment. The holders 208 are metal holder plates that are aligned on the front and back of the arch and secured together with screws, sandwiching the pylons therebetween.

FIGS. 20A-20E are various views of a second pylon 205 (100-60-2130). There two second pylons 205, one assembled on each side of the central pylons 206.

FIGS. 21A-21E are various views of a third pylon 204 (100-60-1970). There two third pylons 204, one assembled next to each second pylon (the direction of assembly described herein is moving from the center to the edges of the arch).

FIGS. 22A-22E are various views of a fourth pylon 203 (100-60-1810). There two fourth pylons 203, one assembled next to each third pylon.

FIGS. 23A-23E are various views of a fifth pylon 202 (100-60-1650). There two fifth pylons 202, one assembled next to each fourth pylon.

FIGS. 24A-24E are various views of a regular pylon 201 (100-60-1480). There ten regular pylons 201. Five regular pylons are assembled on each side of the arch.

Figure 25A:
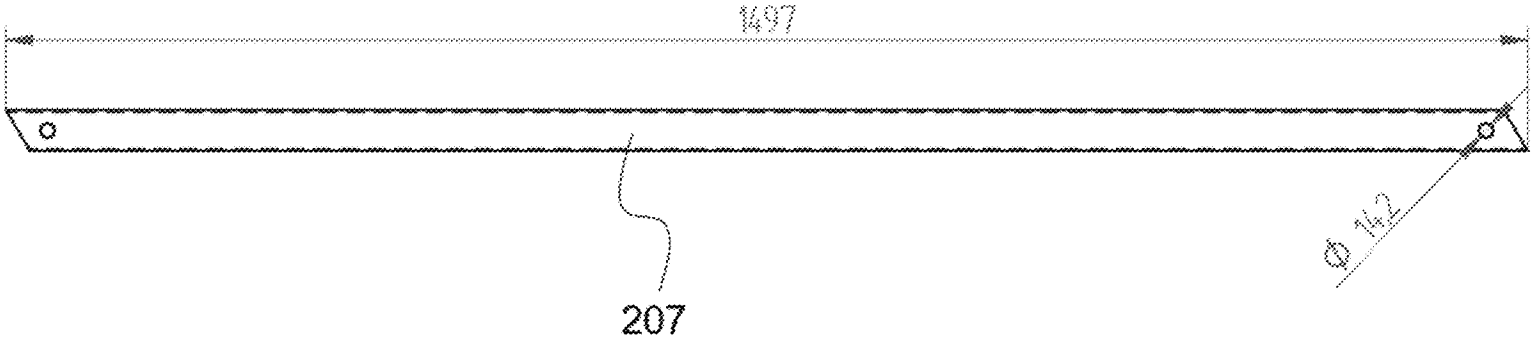
FIGS. 25A-25C are various views of a slanted profile 207.
Figure 25C:
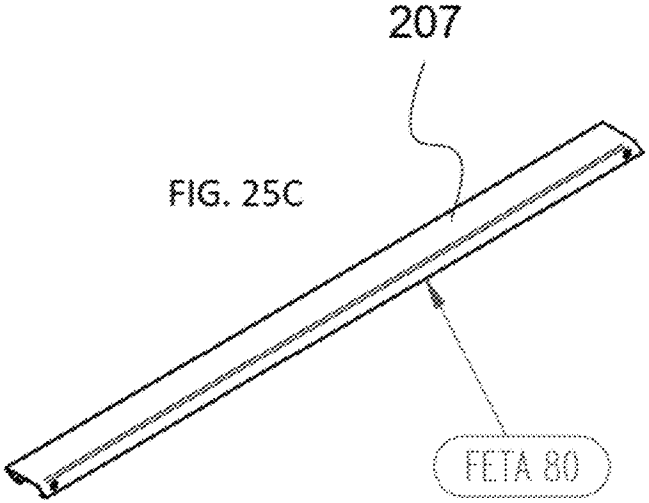
Figure 25B:
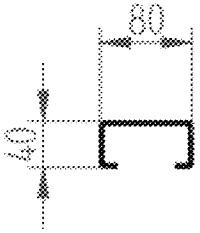

FIGS. 25A-25C are various views of a slanted profile 207 (FETA 80). There are eighteen slanted profiles, nine disposed on each side of the central pylons, between every two pylons. The upper end of the slanted profile slots into an opening in a respective pylon and is secured in place with screws at the upper and lower ends.

Figure 26A:
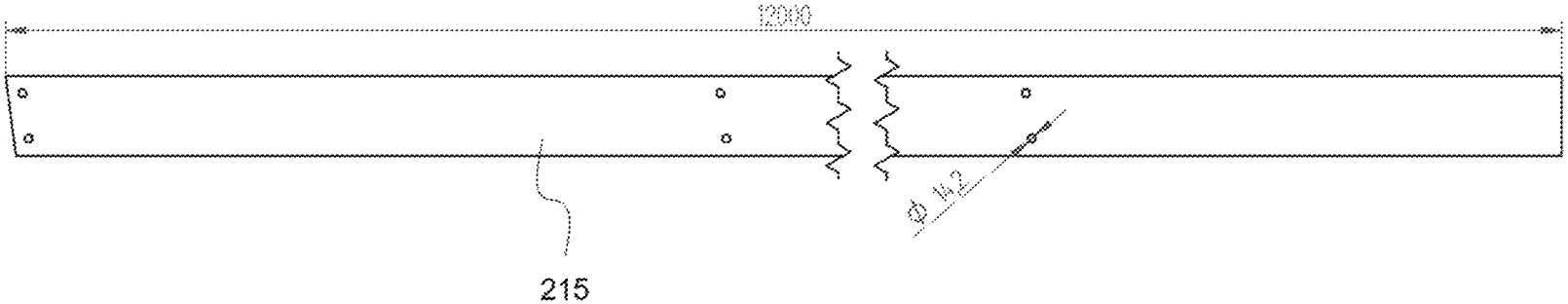
FIGS. 26A-26C are various views of a double-T profile/I-beam 215.
Figure 26C:
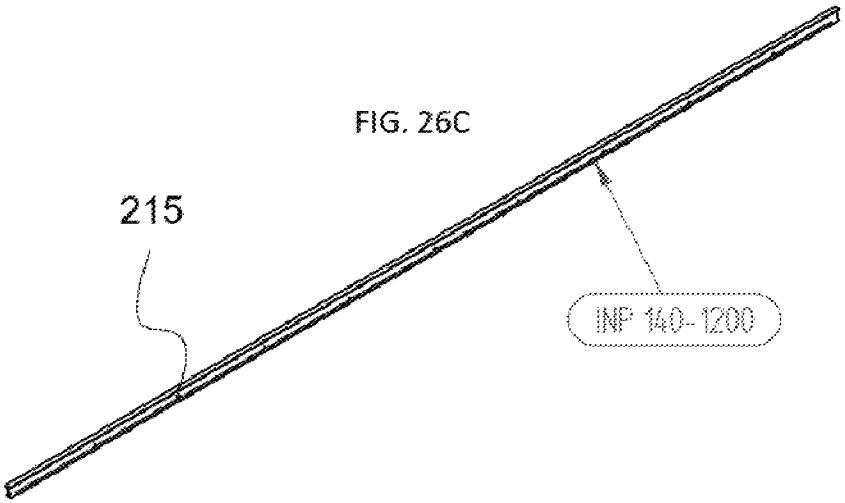
Figure 26B:
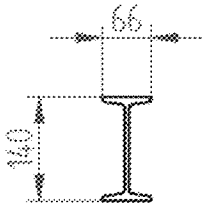

FIGS. 26A-26C are various views of a double-T profile/I-beam 215 (INP 140-1200). There are two double-T profile/I-beam 215, one on each side of the central pylons.

Figure 27A:
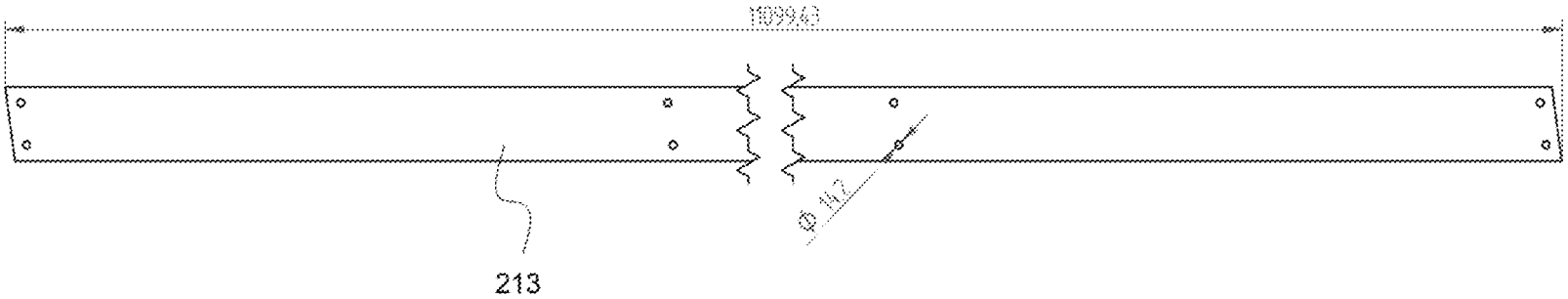
FIGS. 27A-27C are various views of a double-T profile/I-beam 213.
Figure 27C:
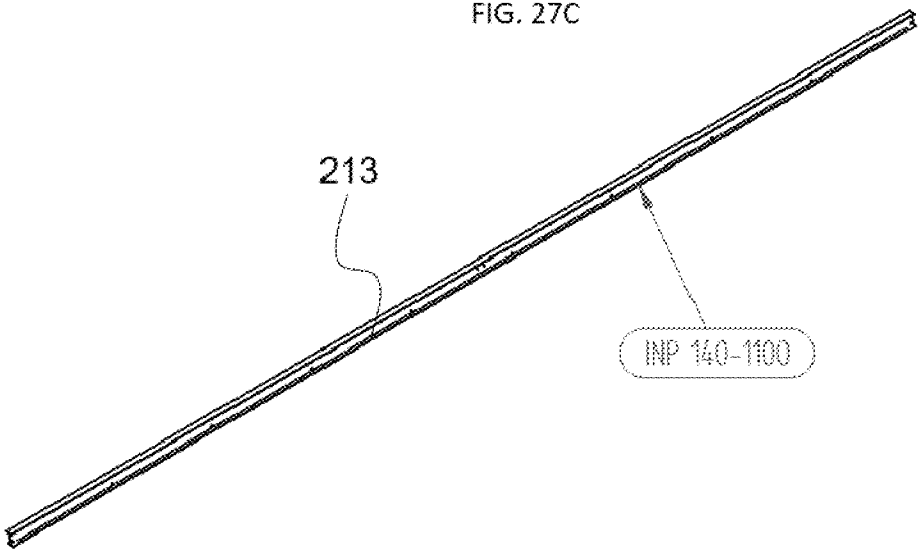
Figure 27B:
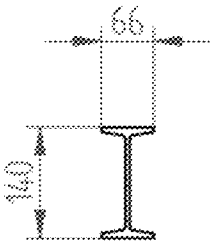

FIGS. 27A-27C are various views of a double-T profile/I-beam 213 (INP 140-1200). There are two double-T profile/I-beam 213, one on each side of the central pylons.

The arch 200 has a left-hand rafter and a right-hand rafter. Each rafter is made up of an upper rafter beam, i.e., double-T profile/I-beam 215, and a lower rafter beam, i.e., double-T profile/I-beam 213.

The upper rafter beam 215 fits through ten pylons: central pylon 206, second pylon 205, third pylon 204, fourth pylon 203, fifth pylon 202, and five regular pylons 201. The upper rafter beam 215 fits through the upper double-T openings.

The lower rafter beam 213 also fits through ten pylons but does not traverse the end regular pylon as the upper beam does, rather it terminates inside the end regular pylon. The lower beam 213 fits through the lower double-T/I-shaped openings in the pylons.

Figure 28A:
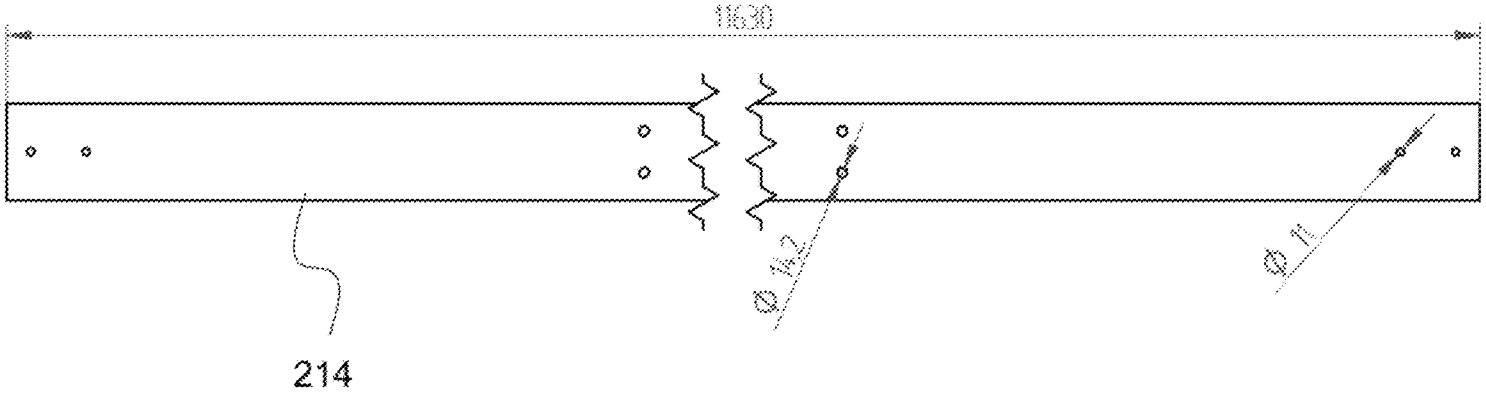
FIGS. 28A-28C are various views of an apex brace 214.
Figure 28C:
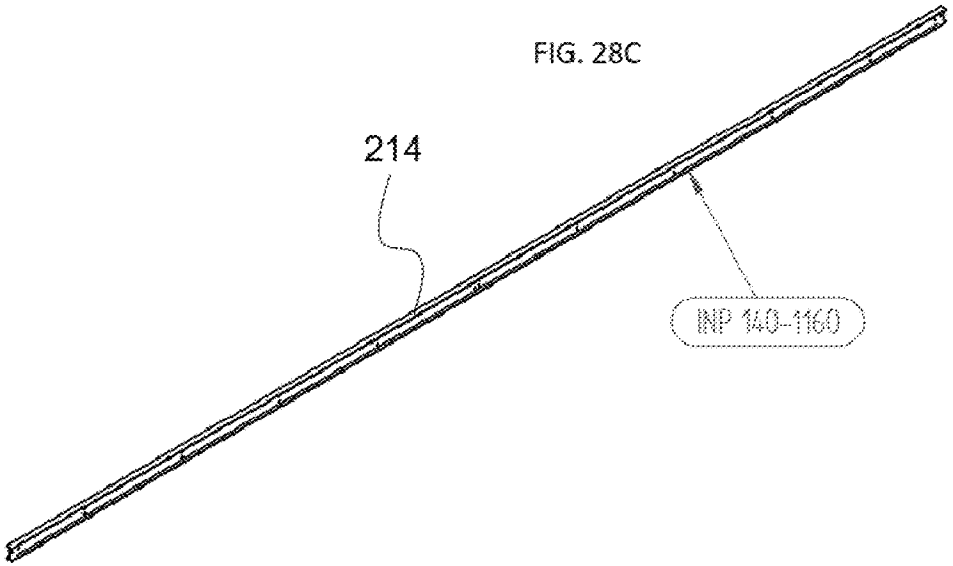
Figure 28B:
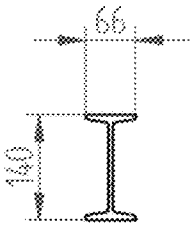

FIGS. 28A-28C are various views of an apex brace 214 (INP 140-1160). The apex brace 214 is an I-beam shaped profile that fits through the open bottoms of the pylons and is fixed in place by screws. The brace 214 is further secured to the lower rafter beams by holder pieces holder pieces on each end thereof. On the left rafter there is a left holder piece 209 (Holder PS L) and a right holder piece 211 (Holder PS R) that are attached together, one the front side and one on the back side of the rafter, secured together by screws, sandwiching the left end of the brace 214 and lower rafter beam 213 therebetween. The mirror image arrangement is found on the right end of the brace 214, which is secured to the lower rafter beam by left holder 210 (Holder PS L mir) and right holder 212 (Holder PS R mir).

Figure 29D:
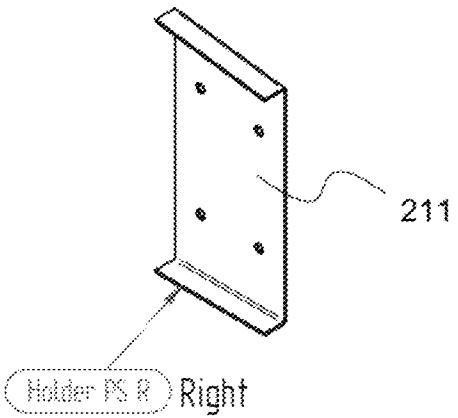
FIG. 29D is an isometric view of right holder 211.
Figure 29C:
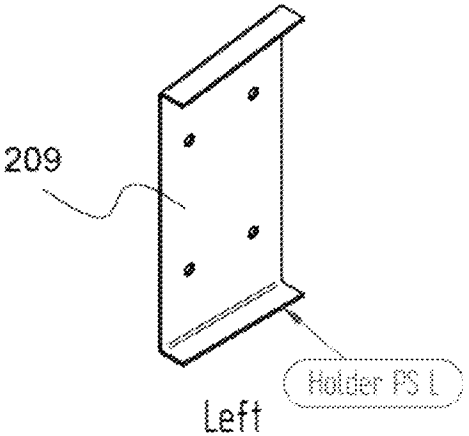
FIG. 29C is an isometric view of left holder 209.
Figure 29A:
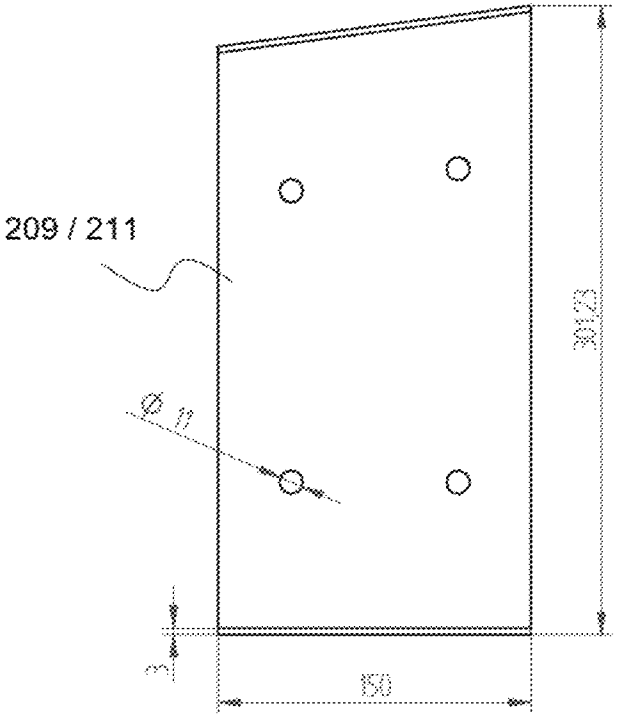
FIGS. 29A and 29B are two views of the holders 209/211.
Figure 29B:
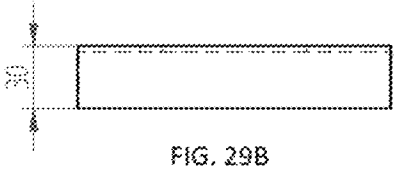

FIGS. 29A and 29B are two views of the holders 209/211. FIG. 29C is an isometric view of left holder 209 and FIG. 29D is an isometric view of right holder 211.

The arches can be assembled and raised in manners known in the art. The arches are connected by purlins (disposed along the Z-axis), as in the prior art canopy 700. The purlins may rest on, and be attached to, the protruding tops of the pylons. Details from the prior art canopy as well as the embodiment 200 are applicable, mutatis mutandis, to the instant embodiment as detailed heretofore.

All of the measurements provided in the drawings are in millimeters and should be seen as if presented herein fully. It is to be appreciated that the measurements are merely exemplary, and not limiting.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

As used herein, the singular form "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. An arch for a metal canopy, comprising:

a right-hand rafter; a left-hand rafter; and an apex brace, wherein each of the right-hand and left-hand rafters includes:

an upper rafter beam and a lower rafter beam, the upper and lower rafter beams having an I-beam shape, a plurality of pylons, each of the pylons having upper and lower I-shaped openings that receive therethrough the upper and lower rafter beams respectively, and at least a portion of the pylons including openings that receive the apex brace therethrough, and a plurality of slanted profiles disposed between every two pylons of the plurality of pylons.

2. The arch of claim 1, wherein the apex brace is an I-beam shaped metal profile.

3. The arch of claim 1, wherein a central pylon of the left-hand rafter is coupled to a central pylon of the right-hand rafter by metal holder plates that sandwich the central pylons between them.

4. The arch of claim 1, wherein an upper end of each slanted profile slots into an opening in a respective pylon of the plurality of pylons.

* * * * *